US008382602B2

(12) United States Patent
Rieber

(10) Patent No.: US 8,382,602 B2
(45) Date of Patent: Feb. 26, 2013

(54) ENCLOSED SLIDE

(76) Inventor: Frederick Rieber, Hamburg, NY (US)

( * ) Notice: Subject to any disclaimer, the term of this patent is extended or adjusted under 35 U.S.C. 154(b) by 321 days.

(21) Appl. No.: 12/903,668

(22) Filed: Oct. 13, 2010

(65) Prior Publication Data

US 2011/0021278 A1 Jan. 27, 2011

Related U.S. Application Data

(63) Continuation-in-part of application No. 11/948,510, filed on Nov. 30, 2007, now Pat. No. 7,815,513.

(51) Int. Cl.
*A63G 21/00* (2006.01)
*A63G 21/18* (2006.01)

(52) U.S. Cl. ..... 472/116; 472/117

(58) Field of Classification Search ..... 472/13, 472/116, 117, 128; 104/55, 69, 70; 285/55, 285/64, 363
See application file for complete search history.

(56) References Cited

U.S. PATENT DOCUMENTS

| | | | | |
|---|---|---|---|---|
| 672,034 | A * | 4/1901 | Cunningham | 285/363 |
| 1,534,333 | A | 4/1925 | Sturges | |
| 1,754,375 | A | 4/1930 | Sturges | |
| 1,949,984 | A * | 3/1934 | Walker | 285/55 |
| 2,013,312 | A | 8/1935 | McIntire | |
| 2,562,785 | A | 7/1951 | Hill | |
| 3,498,325 | A | 3/1970 | Ashton et al. | |
| 3,850,210 | A | 11/1974 | Buxton | |
| 3,877,491 | A | 4/1975 | Thastrup | |
| 4,111,492 | A | 9/1978 | Mraz | |
| 4,135,738 | A | 1/1979 | Clements | |
| 4,231,398 | A | 11/1980 | Gibbons | |
| 4,290,463 | A | 9/1981 | DeGeorge et al. | |
| 4,379,551 | A | 4/1983 | Ahrens | |
| 4,410,281 | A | 10/1983 | Crookes | |
| 4,487,411 | A | 12/1984 | Ahrens | |
| 4,553,308 | A | 11/1985 | Botsolas | |
| 4,722,829 | A | 2/1988 | Giter | |
| 4,844,133 | A | 7/1989 | von Meyerinck et al. | |
| D328,119 | S | 7/1992 | Matsch | |
| 5,226,864 | A | 7/1993 | Showers | |
| 5,379,804 | A | 1/1995 | Dunn et al. | |
| D429,788 | S | 8/2000 | Sutton et al. | |
| 6,213,522 | B1 * | 4/2001 | Jacobson et al. | 285/64 |
| 6,692,041 | B1 | 2/2004 | Coulas, Sr. | |
| 6,758,500 | B2 | 7/2004 | Lehnhardt | |
| 7,488,010 | B2 | 2/2009 | Wellman et al. | |
| 2006/0194638 | A1 | 8/2006 | Hunter | |

* cited by examiner

*Primary Examiner* — Kien Nguyen
(74) *Attorney, Agent, or Firm* — Rader, Fishman & Grauer PLLC

(57) ABSTRACT

An enclosed slide including a number of elongate sections, each section extending between first and second ends thereof, the sections being fastened together in abutting end-to-end relations respectively in a predetermined configuration in which selected pairs of the sections are positioned end-to-end in preselected positions. Each section has a body defining at least a part of a slide bed, and one or more flanges extending outwardly from the body. The flanges positioned at each abutting end of the sections in each selected pair are a pair of flanges positionable adjacent to each other. The enclosed slide also includes a number of clamp rings adapted for securing the adjacent flanges to each other respectively, and a number of fasteners at least partially positionable in flange holes and in the clamp ring holes upon alignment thereof, to at least partially fasten the clamp rings to the adjacent flanges at least partially therein.

19 Claims, 35 Drawing Sheets

ENCLOSED SLIDE

This application is a continuation-in-part of U.S. patent application Ser. No. 11/948,510 filed on Nov. 30, 2007, and hereby incorporates such application in its entirety by reference.

FIELD OF THE INVENTION

This invention is related to enclosed slides.

BACKGROUND OF THE INVENTION

Enclosed slides intended for recreational use are known, and a wide variety are available. In general, the known enclosed slides are made up of a number of segments. Typically, the segments are assembled at the site, to provide a slide bed with curves and slopes as desired. However, assembling the segments is usually relatively slow and painstaking, because identification of the segments, and appropriate positioning of the segments relative to each other during assembly, tend to be time-consuming, and may involve a certain amount of trial and error.

SUMMARY OF THE INVENTION

For the foregoing reasons, there is a need for an improved enclosed slides which overcomes and/or mitigates one or more of the disadvantages of the prior art.

In its broad aspect, the invention provides an enclosed slide including a plurality of elongate sections at least partially defining an elongate slide bed, each section extending between a first end and a second end thereof, the sections being fastened together in abutting end-to-end relations respectively in a predetermined configuration in which selected pairs of the sections are positioned end-to-end in preselected positions relative to each other respectively. Each section includes a body defining at least a part of the slide bed, and one or more flanges extending outwardly from the body, the flange being positioned substantially at one of the ends of the section. The flanges positioned at each of the abutting two ends of the sections in each selected pair include a pair of the flanges positionable adjacent to each other. Each flange in each pair of the adjacent flanges has a number of flange holes substantially aligned with each other when the selected pair of sections with the pair of adjacent flanges are in the preselected positions therefor. The enclosed slide also includes a number of clamp rings adapted for securing the adjacent flanges in each selected pair of sections to each other respectively, each pair of adjacent flanges being at least partially receivable in the clamp rings respectively. Each clamp ring includes a number of clamp ring holes substantially alignable with the flange holes in the pair of adjacent flanges respectively when the selected pair of the sections with the pair of adjacent flanges are in the preselected positions therefor. The enclosed slide also includes a number of fasteners at least partially positionable in the flange holes and in the clamp ring holes upon alignment thereof, to at least partially fasten the clamp rings respectively to the adjacent flanges at least partially received therein, for securing together the selected pair of said sections on which the pair of the adjacent flanges are located when in the preselected positions therefor.

In another aspect, each clamp ring has one or more body segments defining one or more slots in which the pair of adjacent flanges is at least partially receivable.

In another of its aspects, each clamp ring includes one or more locking mechanisms for locking the body segments together in end-to-end relation, to at least partially hold each clamp ring on each pair of adjacent flanges respectively.

In yet another aspect, the invention provides one or more indicators disposed on the body of each section respectively for locating each section in each selected pair respectively relative to each other in the preselected positions therefor.

BRIEF DESCRIPTION OF THE DRAWINGS

The invention will be better understood with reference to the attached drawings, in which:

FIG. 22B is a flow chart schematically illustrating a second part of the method of

FIG. 22A.

DETAILED DESCRIPTION

Figure 1:
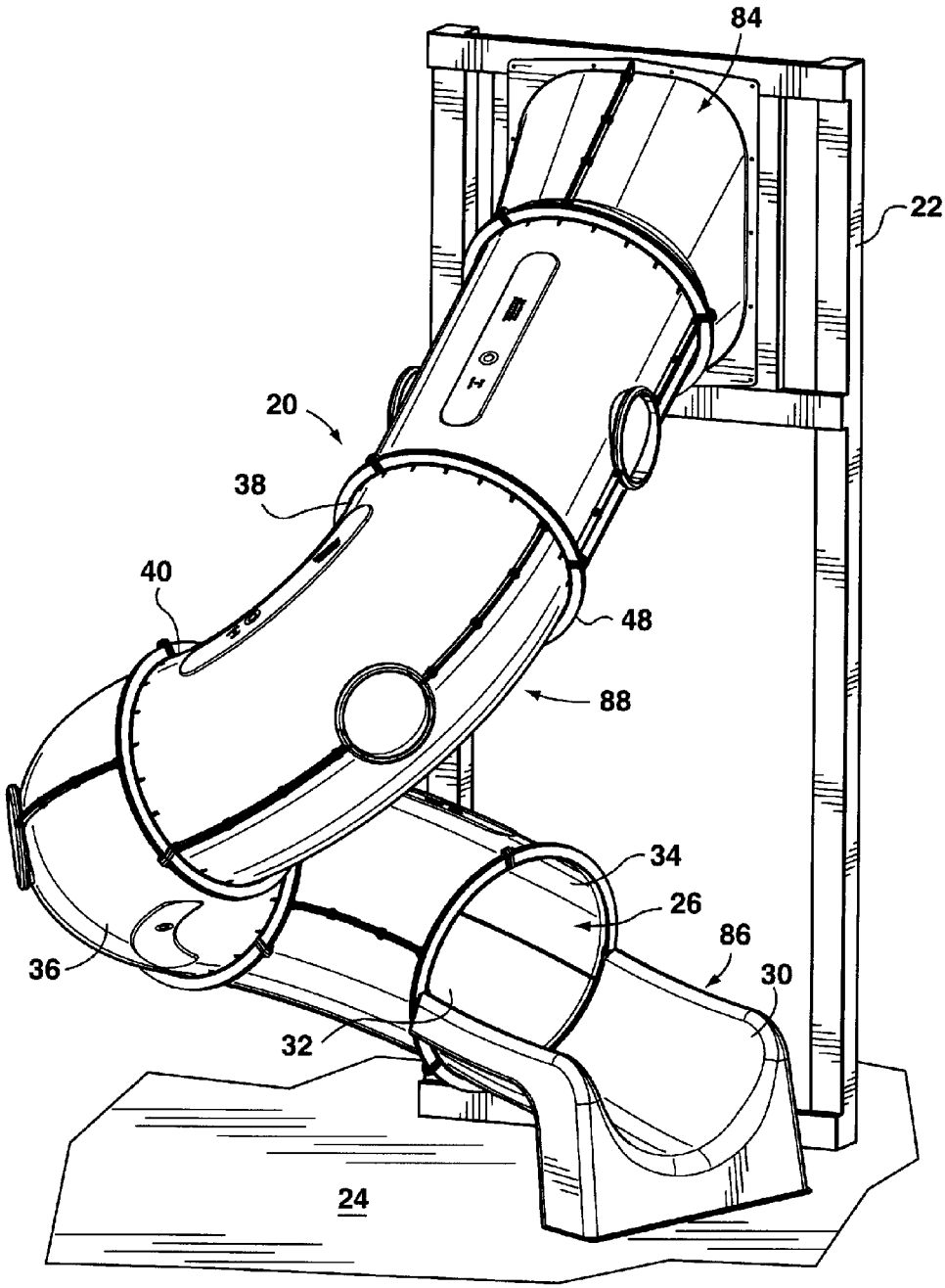
FIG. 1 is an isometric view of an embodiment of an enclosed slide of the invention after assembly thereof.
Figure 2:
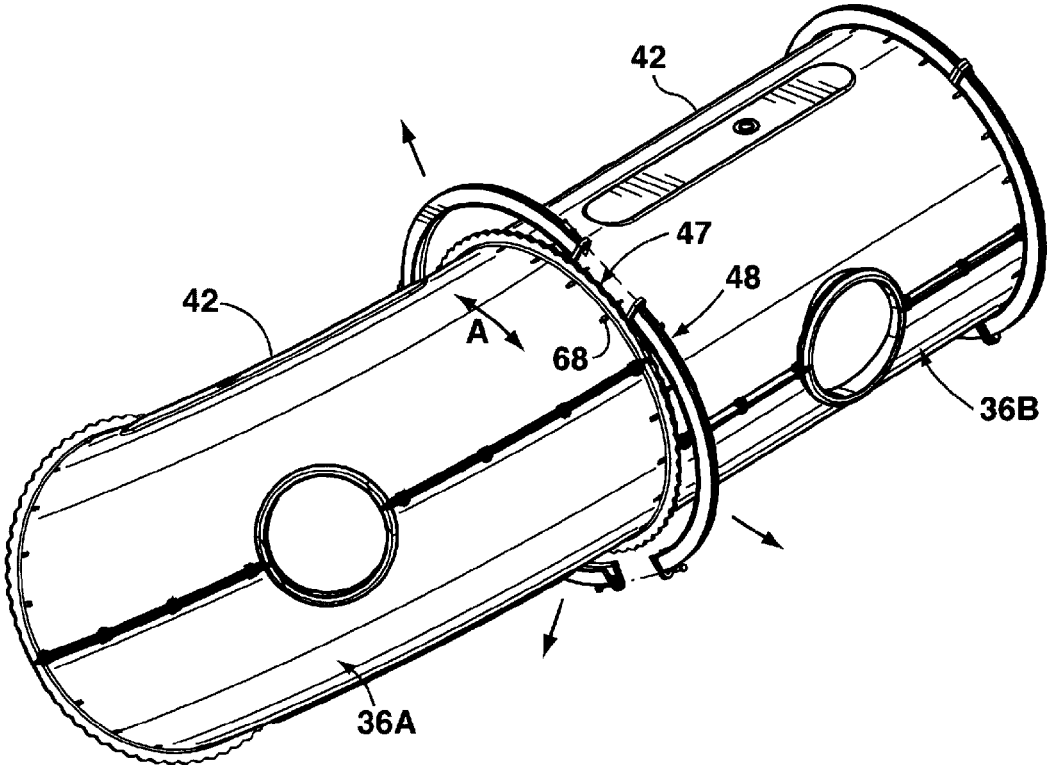
FIG. 2 is an isometric view of two sections positioned end-to-end, with a pair of flanges positioned adjacent to each other and an embodiment of a clamp ring of the invention disengaged from the flanges, drawn at a larger scale.
Figure 2A:
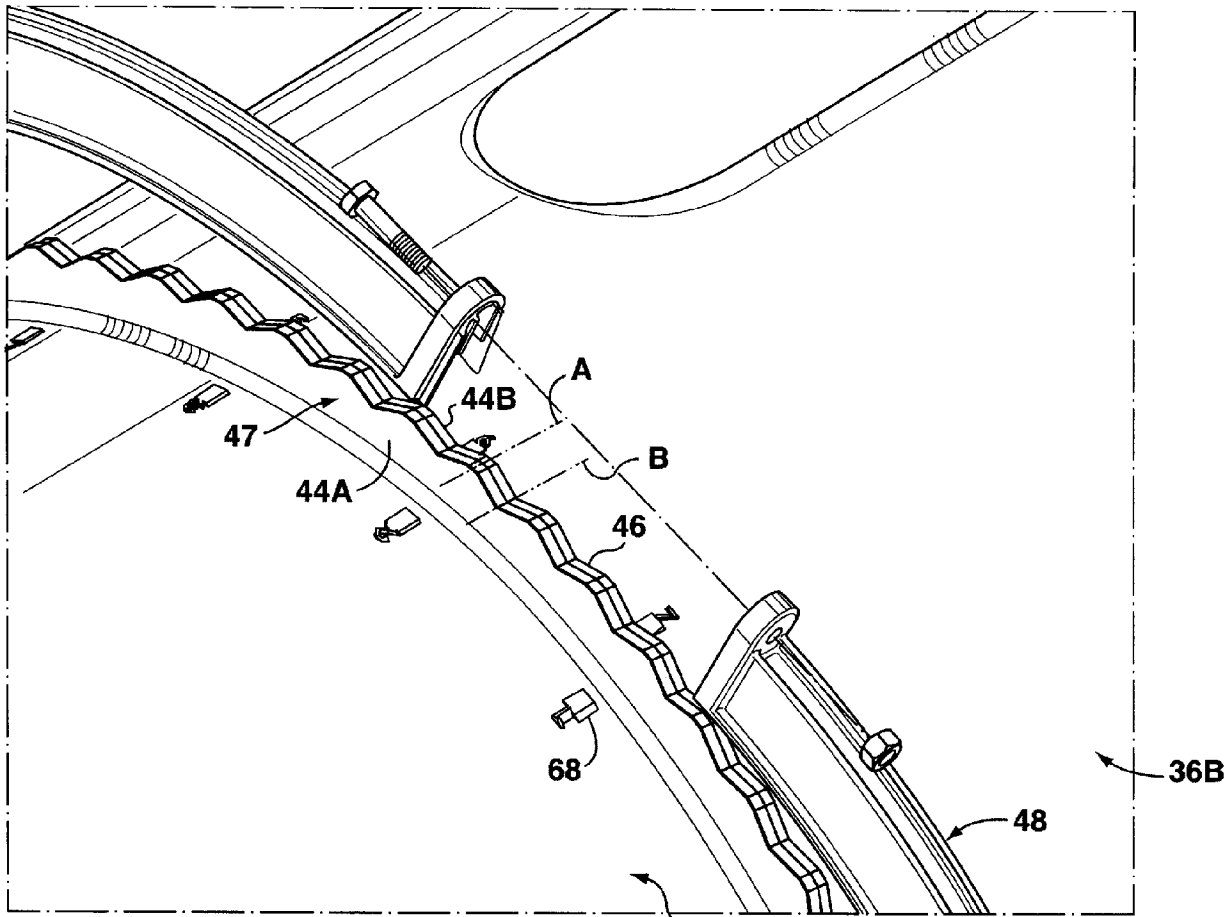
FIG. 2A is an isometric view of a portion of the pair of adjacent flanges of FIG. 2, drawn at a larger scale.

In the attached drawings, like reference numerals designate corresponding elements throughout. Reference is first made to FIGS. 1-9 to describe an embodiment of an enclosed slide of the invention generally identified by the reference numeral 20. As can be seen in FIG. 1, the enclosed slide 20 extends between a deck 22 located above a ground surface 24 and the ground surface 24. The enclosed slide 20 includes an elongate slide bed 26 extending between a top end 24 proximal to the deck 22 and a bottom end 30 proximal to the ground surface 24. Preferably, the slide bed 26 includes a floor portion 32 and a roof portion 34 defined by a plurality of elongate sections 36. As can be seen in FIGS. 1 and 2, each section 36 preferably extends between a first end 38 and a second end 40 thereof. The sections 36 preferably are connected together in abutting end-to-end relations respectively in which two of the sections 36 are positioned end-to-end (FIGS. 1, 2, 2A). It is also preferred that each section 36 includes a body 42 defining a portion of the slide bed 26 and one or more flanges 44 extending outwardly from the body 42 and ending in a notched edge 46 (FIG. 2). The flange 44 preferably is positioned substantially at one of the ends 38, 40 (FIGS. 2, 2A). Also, the flanges 44 which are positioned at the abutting two ends 38, 40 of respective sections 36 preferably comprise a pair 47 of flanges 44 adjacent to each other. The notched edges 46 on each pair 47 of adjacent flanges are substantially aligned with each other when the sections 36 are assembled end-to-end (FIGS. 2, 2A). It is also preferred that the enclosed slide 20 includes a number of clamp rings 48. Each clamp ring 48 includes a notched portion 50 for mating with the notched edges 46 of each pair of adjacent flanges 44 respectively (FIGS. 4, 6, 7). Each clamp ring 48 is adapted for securing the adjacent flanges 44 of each pair 47 of flanges to each other respectively.

Figure 4:
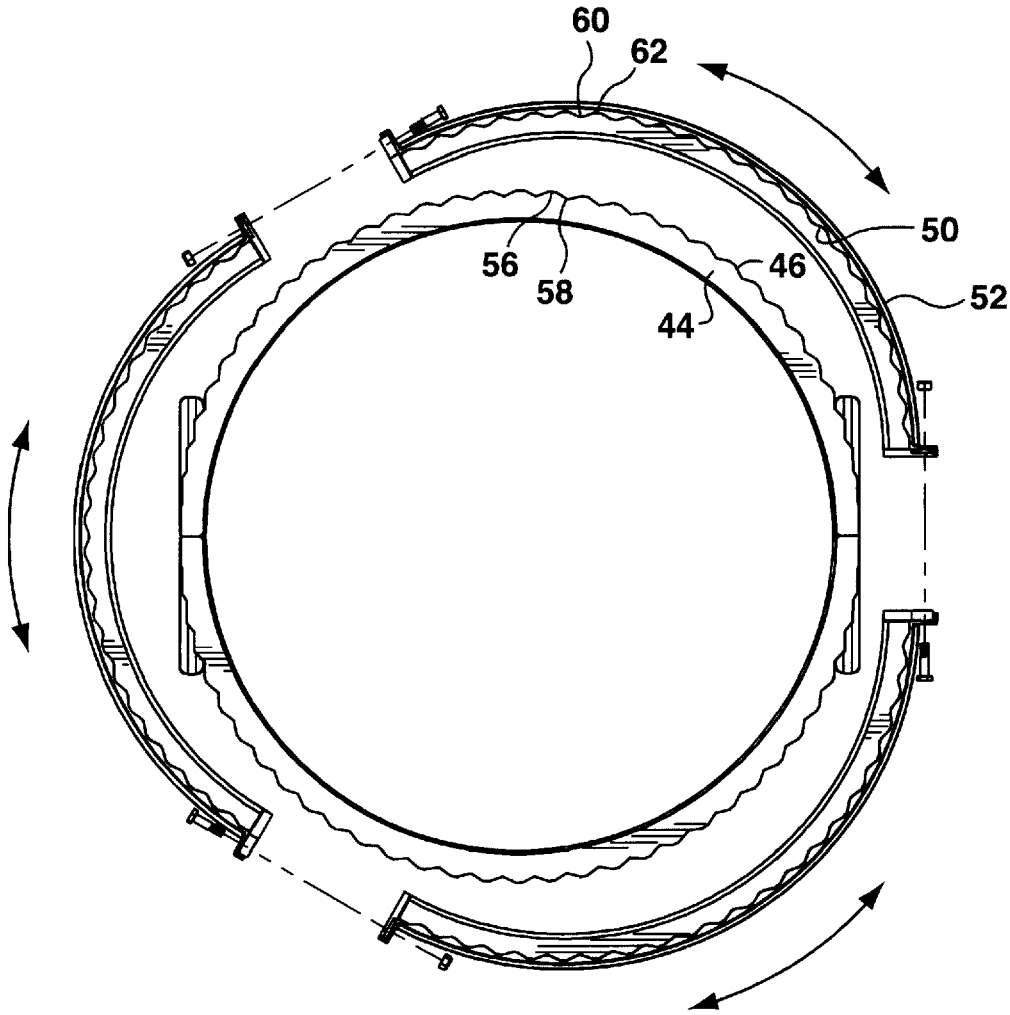
FIG. 4 is a cross-section showing a notched edge on an embodiment of a flange of the invention and a notched portion in the clamp ring of FIG. 2, drawn at a larger scale.
Figure 5:
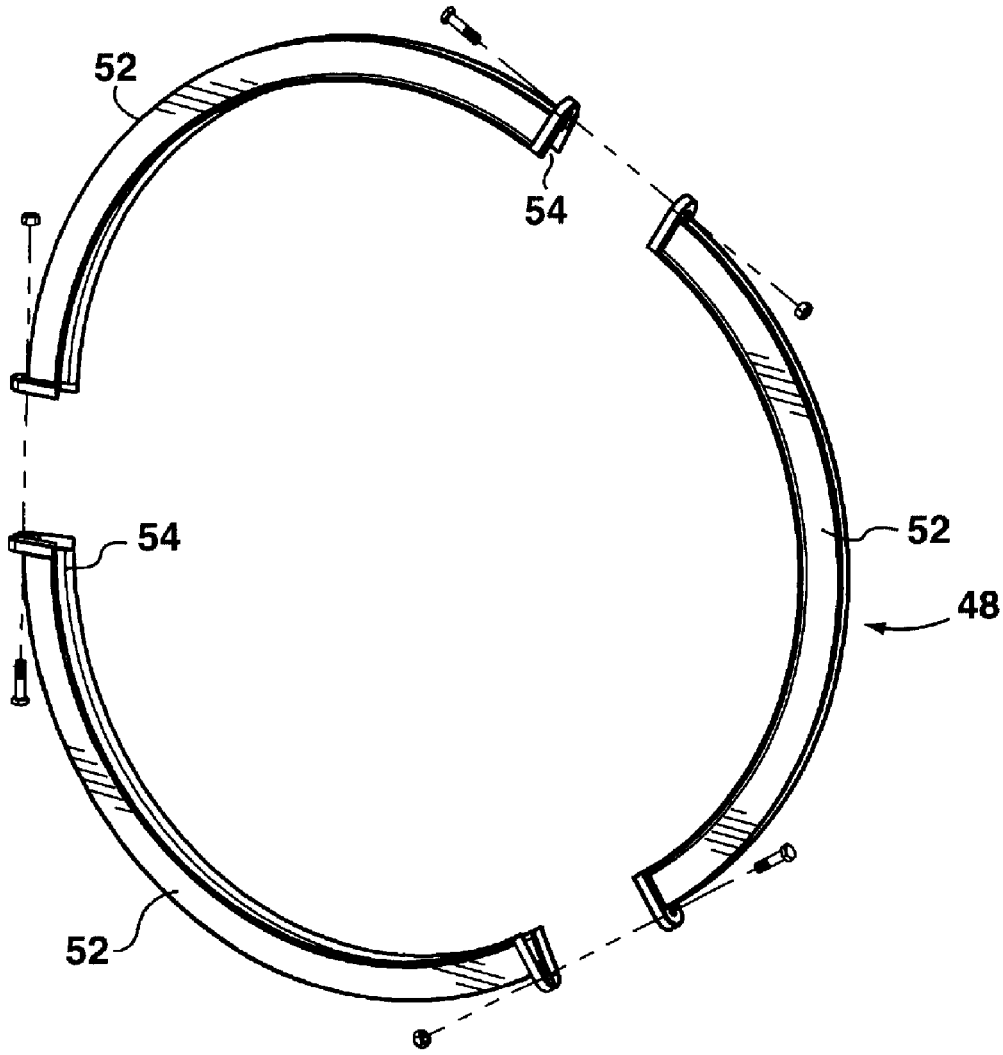
FIG. 5 is an isometric view of the clamp ring of FIG. 2.
Figure 6:
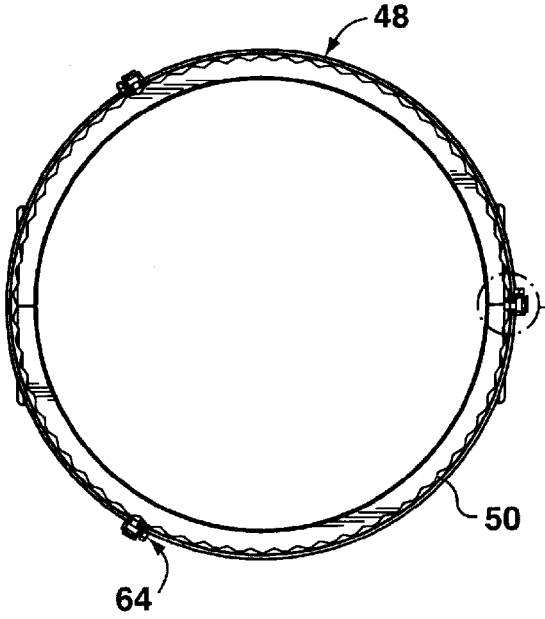
FIG. 6 is a cross-section showing the notched portion and the notched edge of FIG. 4 meshed and locked together, drawn at a smaller scale.
Figure 7:
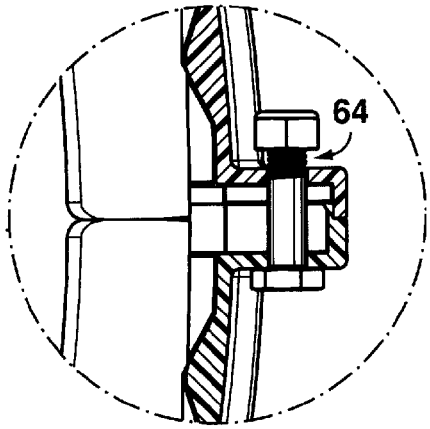
FIG. 7 is a cross-section showing an embodiment of a locking mechanism of the invention in the clamp ring of FIG. 7 in an engaged position, drawn at a larger scale.

Preferably, and as can be seen in FIGS. 4 and 5, each clamp ring 48 includes one or more body segments 52 defining a slot 54 in which the pair 47 of adjacent flanges 44 are at least partially received (FIGS. 4, 6, 7). As shown in FIGS. 4, 6, and 7, the body segment 52 preferably includes the notched portion 50 in the slot 54 for mating with the notched edges 46 of the pair 47 of the adjacent flanges 44. As can be seen in FIGS. 6 and 7, the pair 47 of adjacent flanges 44 is thereby located in a predetermined aligned relation relative to each other.

Preferably, the notched edge 46 includes a number of first teeth 56. Each first tooth 56 is spaced apart from the first teeth 56 which are located proximal thereto by first notches 58. Similarly, the notched portion 50 includes a number of second teeth 60, and each second tooth 60 is spaced apart from the second teeth 60 which are located proximal thereto by second notches 62. The second teeth 60 and the second notches 62 are sized and positioned to mesh with the first teeth 56 and the first notches 58 in the notched edges 46 (FIG. 4).

As can be seen in FIG. 2A, when the pair 47 of adjacent flanges 44 are located in the predetermined relation relative to each other, such flanges are in a side-by-side relation to each other and engage each other.

Preferably, each clamp ring 48 includes one or more locking mechanisms 64 for locking the notched portion 50 of each clamp ring 48 and the notched edges 46 of each pair 47 of the flanges together, when the first teeth 56 and first notches 58 are meshed with the second notches 62 and the second teeth 60 respectively, to substantially maintain each pair 47 of adjacent flanges 44 in a predetermined relation relative to each other (FIGS. 4, 6, 7). The locking mechanism 64 preferably includes any suitable locking device. For instance, and as shown in FIGS. 6 and 7, in one embodiment, the locking mechanism is a suitable fastener, such as a nut and bolt.

As can be seen in FIGS. 4-7, each locking mechanism 64 is movable between an engaged position (FIGS. 6, 7), in which the notched portion 50 of the body segment 52 and the notched edges 46 of the pair 47 of adjacent flanges 44 are secured together, and a disengaged position (FIGS. 2, 2A, 4, 5), in which the notched portion 50 and the notched edges 46 are unsecured so that movement of the adjacent flanges 44 in the pair 47 relative to each other is permitted. Preferably, and as indicated in FIGS. 2 and 2A, when the locking mechanism 64 is in the disengaged position, rotational movement of the two abutting sections relative to each other is permitted. For instance, rotational movement of the abutting section designated as 36A in FIG. 2 is permitted relative to the section designated as 36B abutting thereto, in the directions indicated by two-ended arrow "A".

Preferably, and as shown in FIGS. 2, 2A, 12, and 13, the slide 20 also includes a number of indicators 68. Each of the indicators 68 is disposed on the body 42 of each section 36 for rotationally positioning each section 36 relative to each section 36 abutting thereto in a preselected relation relative to each other, as will be described. It is also preferred that the abutting sections are in the preselected relation relative to each other when selected ones of the indicator 68 on the two abutting sections respectively are aligned with each other.

Figure 3:
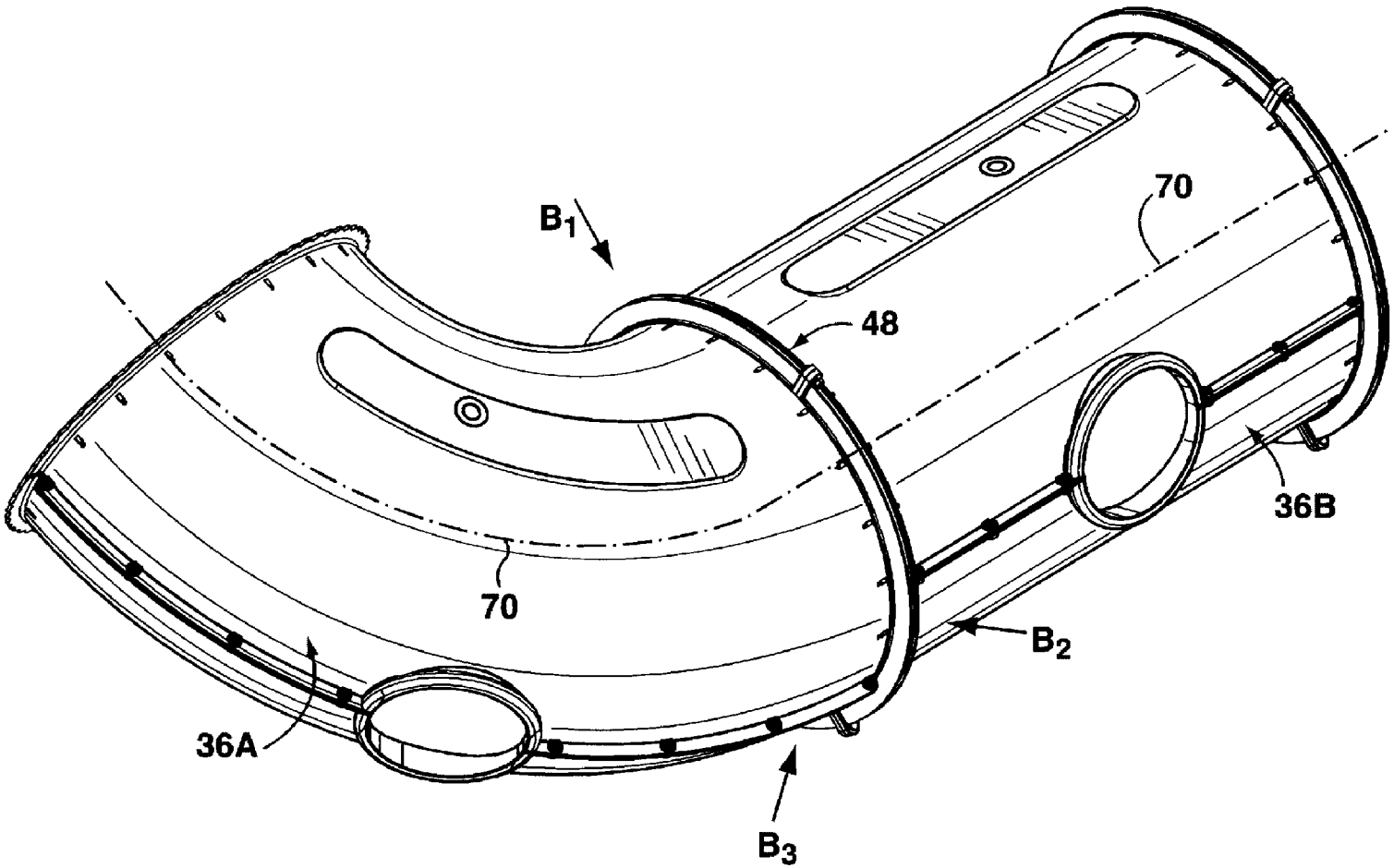
FIG. 3 is an isometric view of the two sections of FIG. 2 with the clamp ring of FIG. 2 positioned on the adjacent flanges thereof, drawn at a smaller scale.

As can be seen in FIG. 3, the slide bed 26 is generally symmetrically oriented about respective central axes 70 of the sections 36. (It will be understood that, where the section 36 is generally curved, the associated central axes 70 may also be curved.) The locking mechanisms 64 in each clamp ring 48 are adapted to urge the body segments 52 of the clamp ring 48 respectively radially inwardly (i.e., in the directions indicated by arrows $B_1$, $B_2$, and $B_3$ in FIG. 3), substantially toward the respective central axes 70 of each section 36.

Preferably, each clamp ring 48 is securable to substantially prevent movement of the abutting sections 36 relative to each other, and releasable to permit movement of the notched edges 46 of each pair 47 of adjacent flanges 44 relative to each other.

Figure 10:
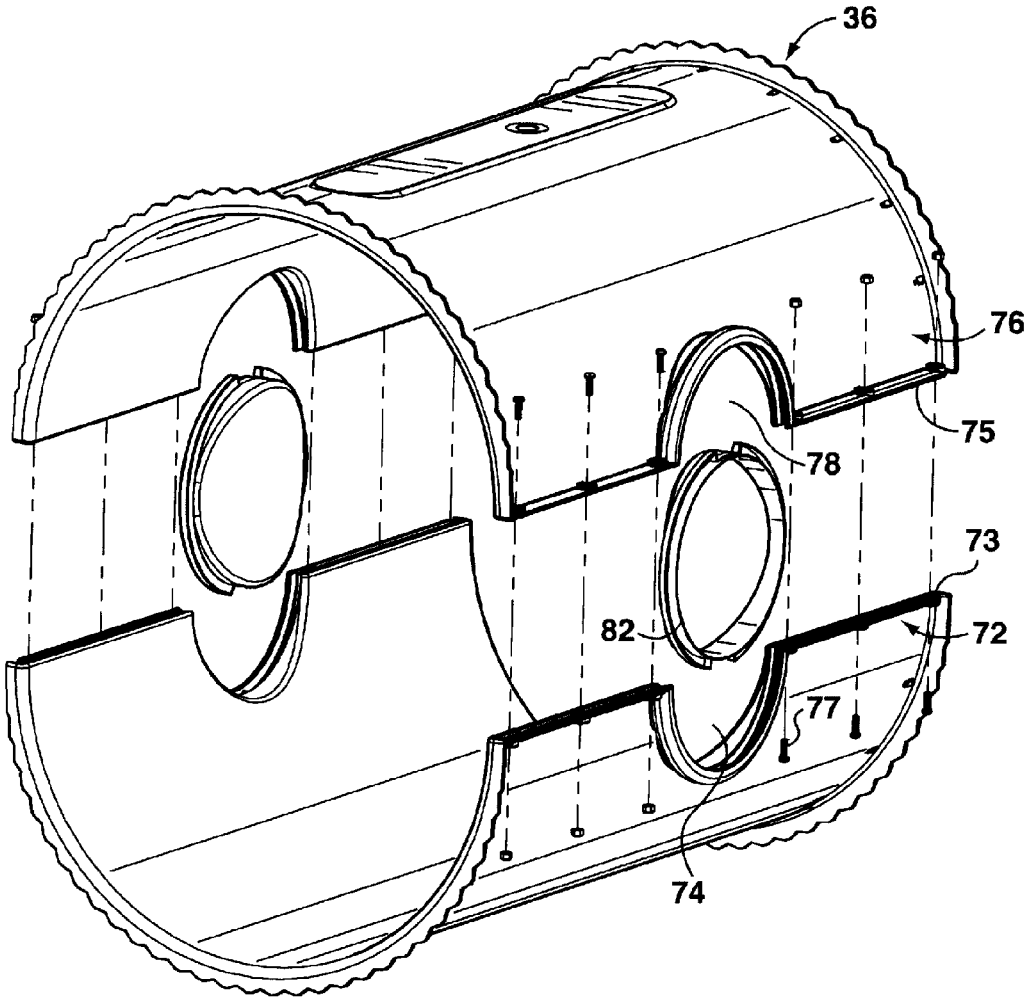
FIG. 10 is an isometric view of the top and bottom portions of an embodiment of a section of the invention in an unassembled condition, drawn at a smaller scale.
Figure 11:
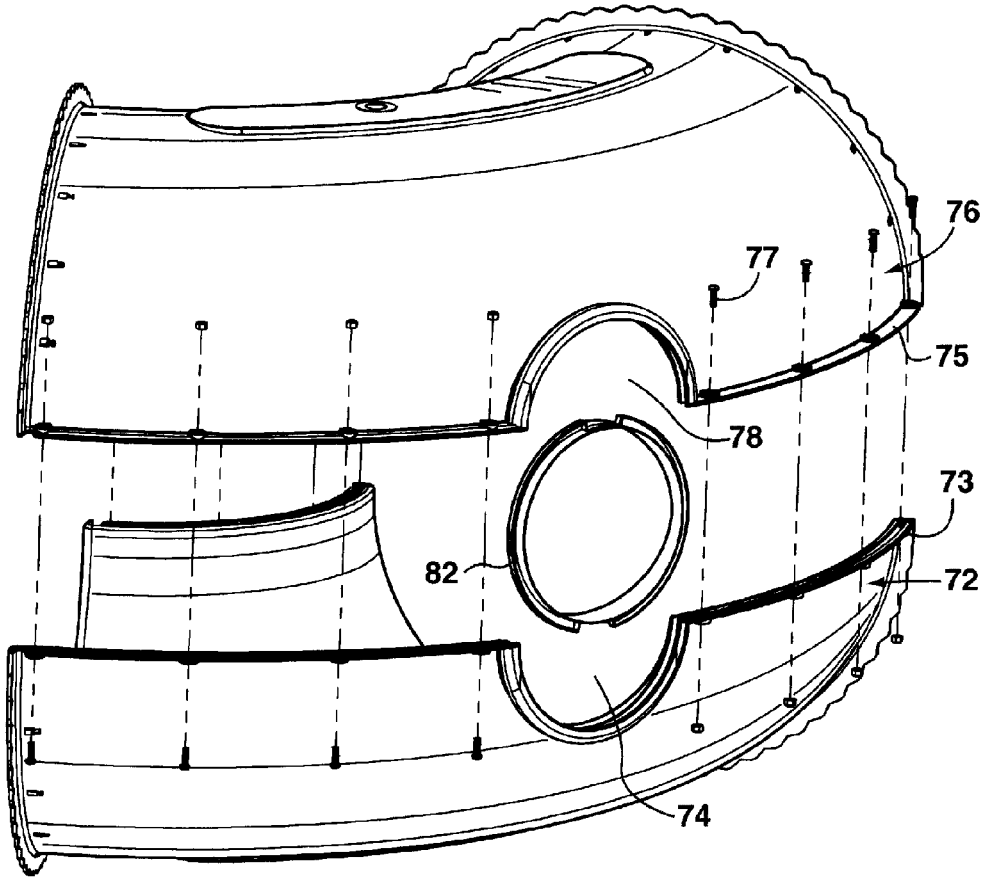
FIG. 11 is an isometric view of an alternative embodiment of a section of the invention in an unassembled condition.
Figure 12:
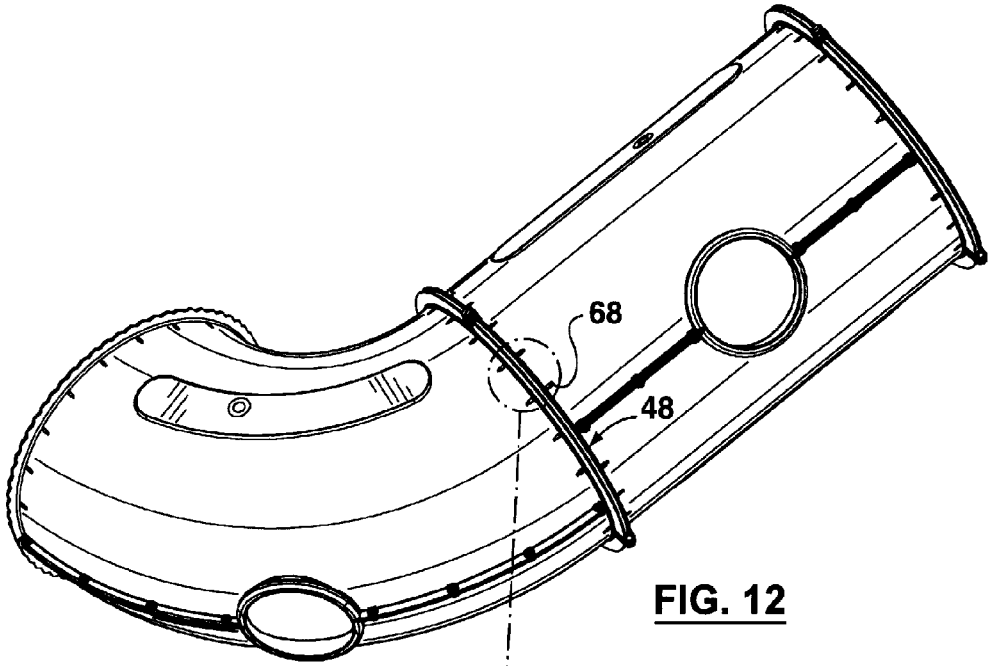
FIG. 12 is an isometric view of two abutting sections with indicators positioned on each section respectively, drawn at a smaller scale.
Figure 13:
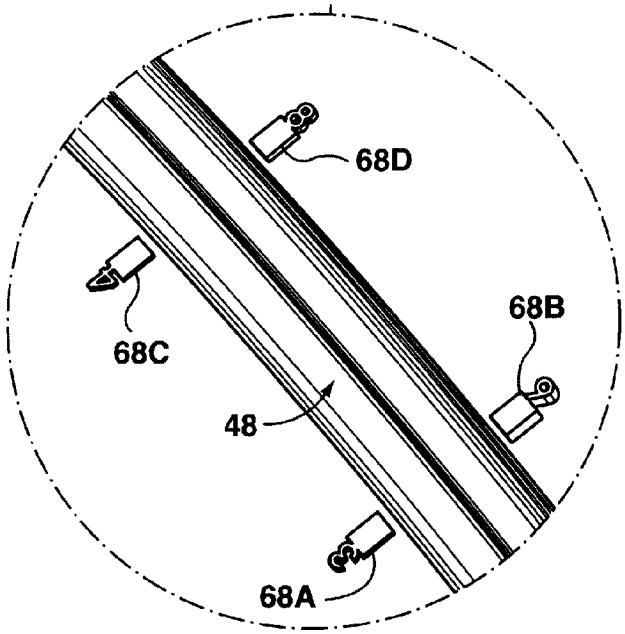
FIG. 13 is an isometric view of portions of the abutting sections of FIG. 12, drawn at a larger scale.

In one embodiment, one or more of the sections 36 includes a bottom portion 72 with one or more first aperture parts 74, and a top portion 76 with one or more second aperture parts 78. As can be seen in FIG. 10, when they are attached together, the top and bottom portions 76, 72 cooperate with each other to substantially form the body 42 of the section. Preferably, the top and bottom portions 76, 72 include respective ridges 73, 75 which are adapted to mate with each other when the top and bottom portions 76, 72 are put together. It is also preferred that the top and bottom portions 76, 72 are fastenable together by suitable fasteners 77. The first and second aperture parts 74, 78 are positioned so that when the top and bottom portions 76, 72 are attached together, the first and second aperture parts 74, 78 collectively define an aperture in which a window 82 is receivable (FIGS. 10, 11). Preferably, the window 82 allows the slide bed 26 to be at least partially illuminated by ambient light via the window 82. Also, a user (not shown) in the slide bed can look outwardly via the window 82. Accordingly, the window 82 generally results in a more enjoyable experience for the user. In one embodiment, and as can be seen in FIG. 1, the enclosed slide 20 preferably includes a number of windows 82.

Figure 8:
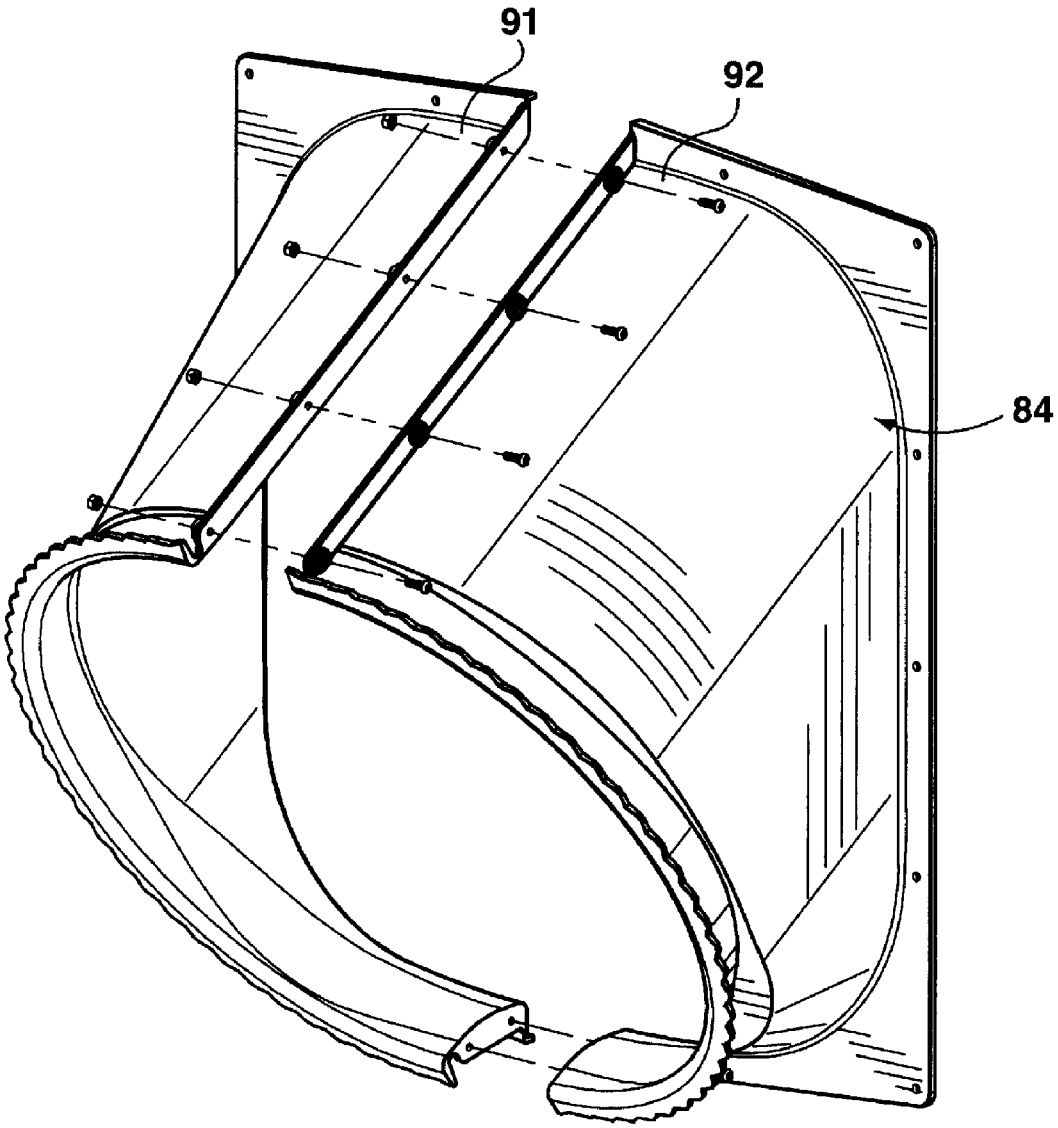
FIG. 8 is an isometric view of an embodiment of a top section of the invention in an unassembled condition, drawn at a smaller scale.
Figure 9:
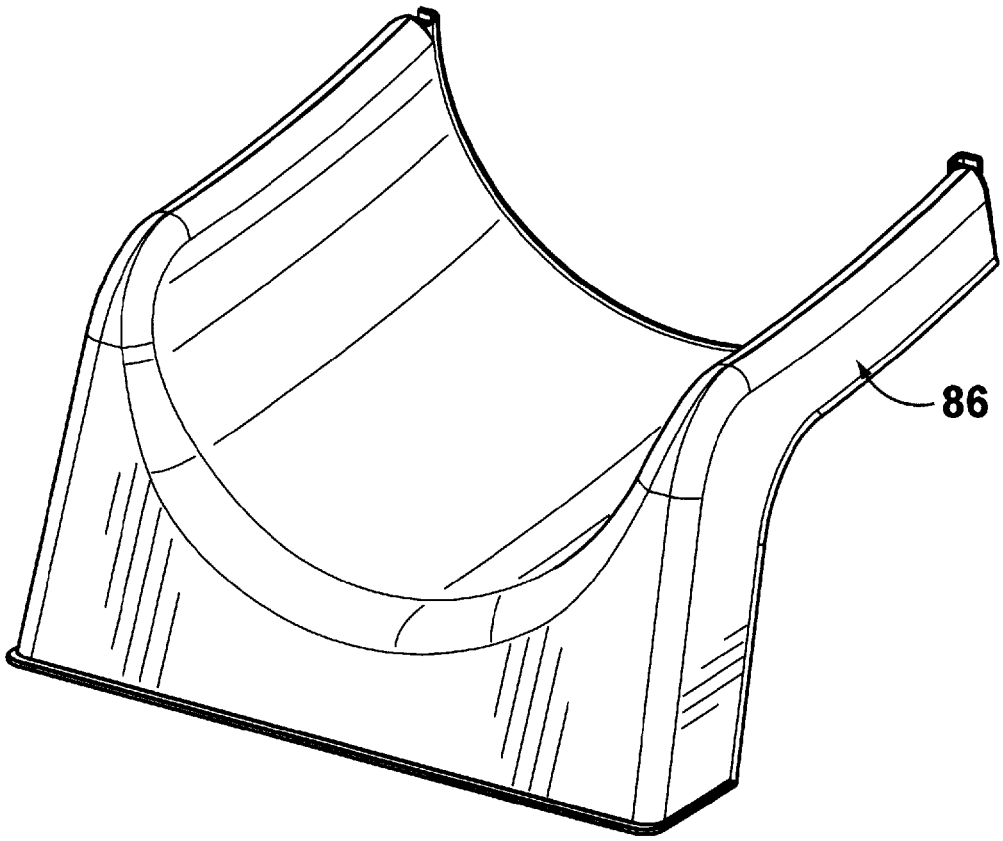
FIG. 9 is an isometric view of an embodiment of a bottom section of the invention.

Preferably, and as can be seen in FIG. 1, the sections 36 include a top section 84 which is adapted to be positioned proximal to the deck 22 and a bottom section 86 adapted to be positioned proximal to the ground surface 24. The sections 36 also include a number of connecting sections 88 (FIG. 1) which are adapted to be positioned end-to-end for connecting the top and bottom sections 84, 86. As shown in FIG. 1, the sections 36 preferably are attachable together so that the slide bed 26 defined in the connecting sections 88 is substantially continuous. Embodiments of the top and bottom sections 84, 86 are also shown in FIGS. 8 and 9. Although the top section 84 is shown as being formed of two parts 91, 92 divided substantially vertically, it will be understood that the top section 84 may alternatively be formed of one piece or of two pieces otherwise divided, as preferred.

Figure 15A:
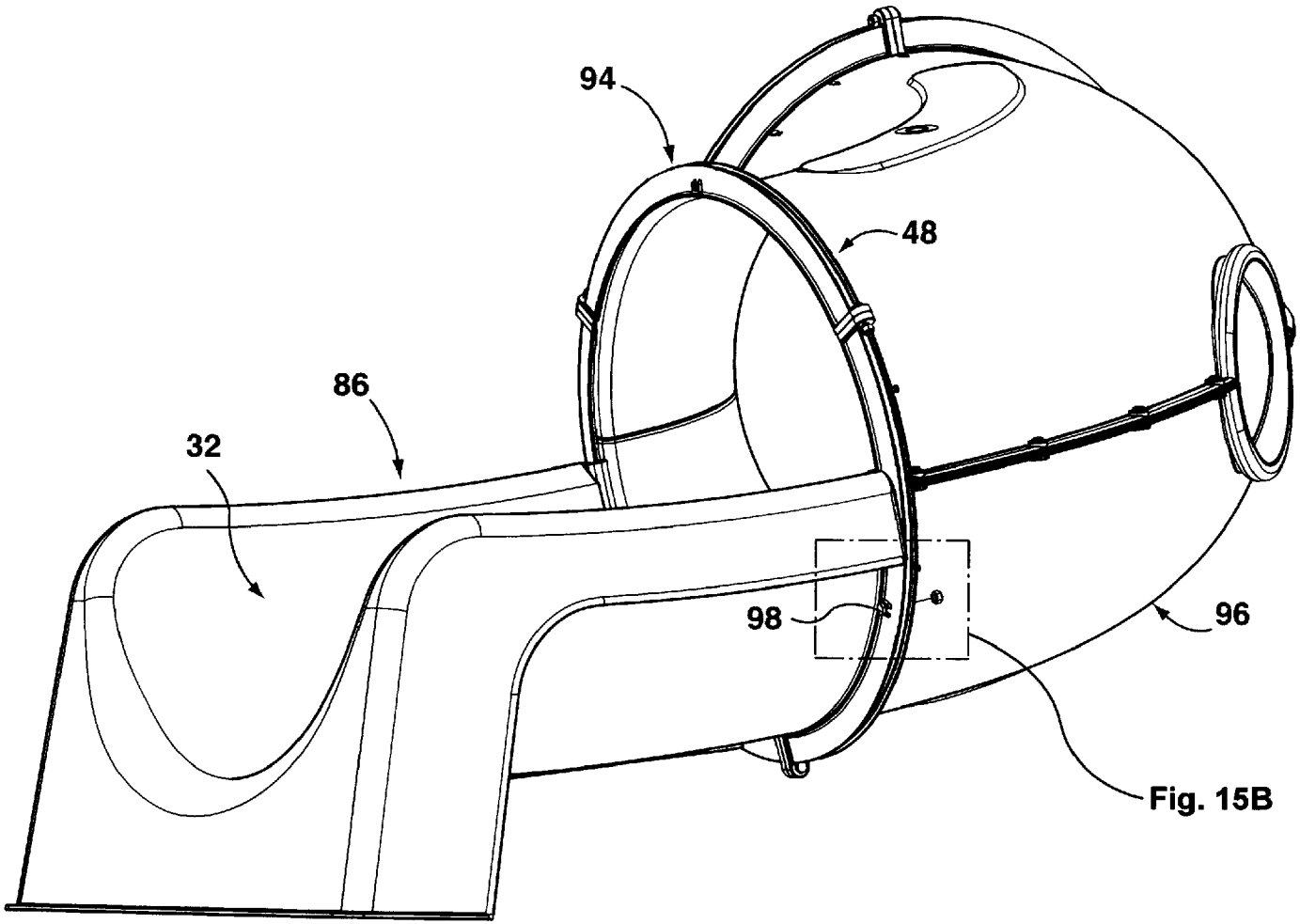
FIG. 15A is an isometric view of the bottom portion with a connecting section attached thereto, drawn at a smaller scale.
Figure 15B:
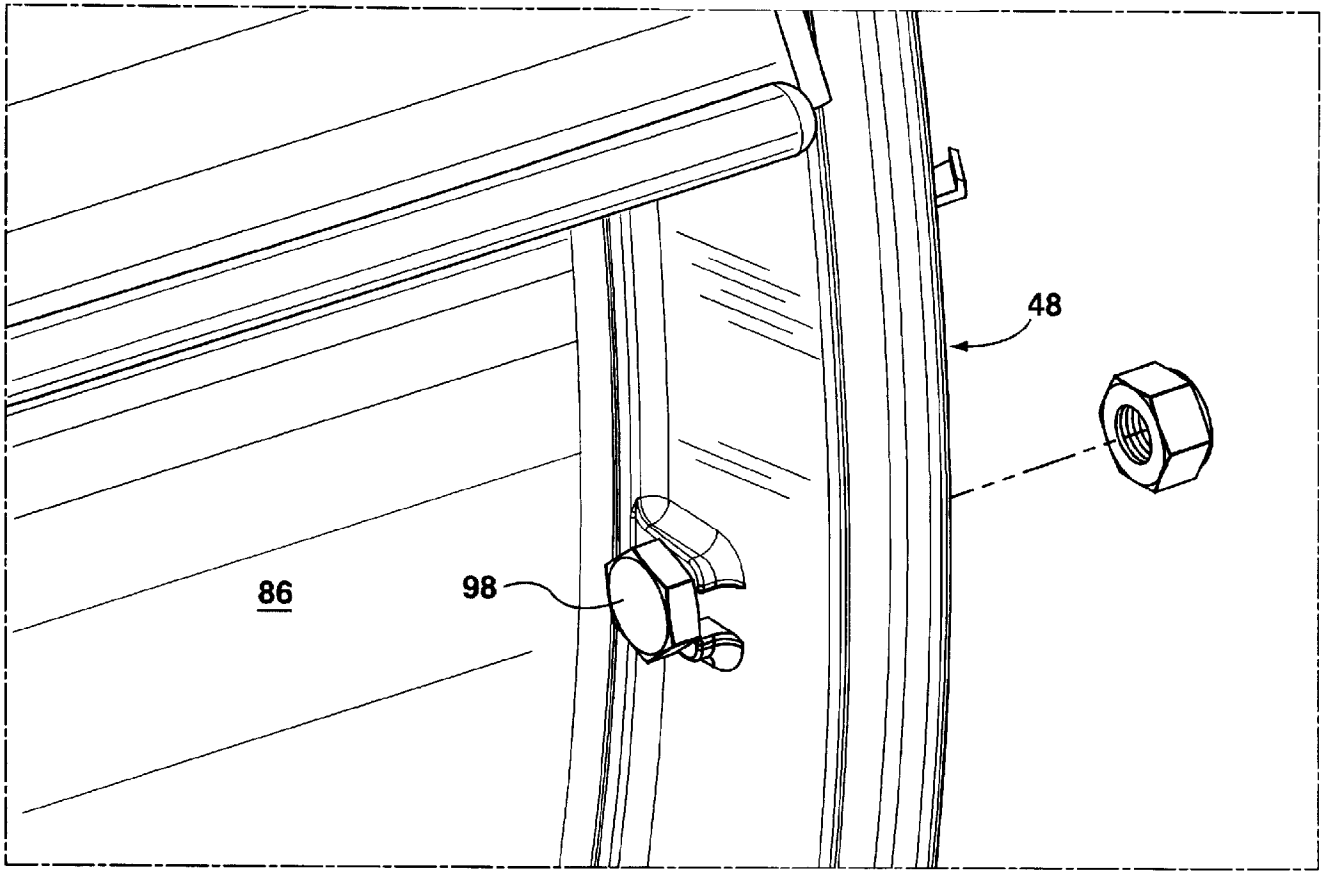
FIG. 15B is an isometric view of a portion of the bottom section showing the manner in which the bottom section is attached to the connecting section, drawn at a larger scale.

In one embodiment, the bottom section 86 includes a flange portion with a notched edge (not shown) positioned proximal to the part of the slide bed floor portion 32 defined by the bottom section 86, and abutting a flange (not shown) at an end 94 of a lowermost connecting section 96. Preferably, the abutting flange on the section 96 and the flange portion are secured together by the clamp ring 48 so that the notched edges of the flange and the flange portion are aligned. Because the flange on the bottom section 96 does not extend proximal to the roof portion of the slide bed, additional fasteners 98 are used to more securely attach the clamp ring 48, the flange, and the flange portion together. As can be seen in FIGS. 15A and 15B, each fastener 98 preferably is a nut and bolt. However, it will be understood that any suitable fasteners could be used to better secure the bottom section 86 to the lowermost connecting section 96.

The sections 36 preferably are made of any suitable material, e.g., any suitable injection molded plastic.

Figure 14:
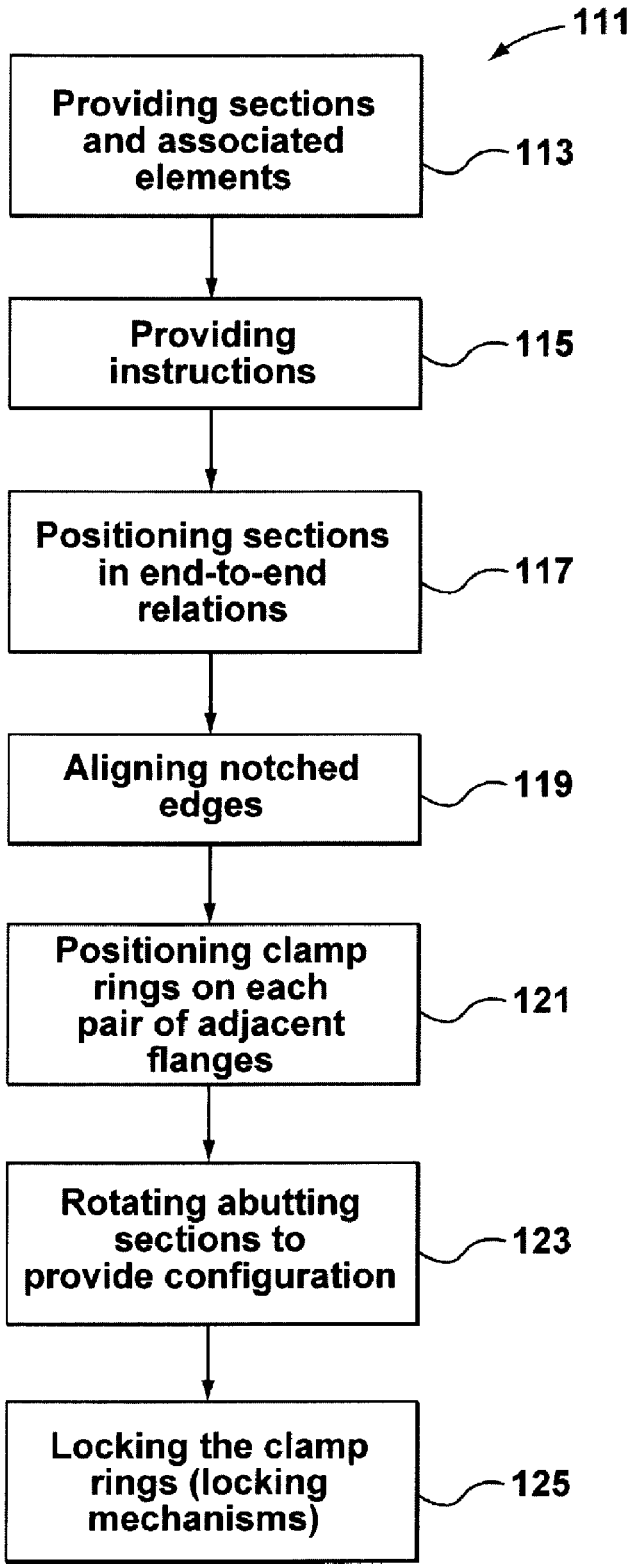
FIG. 14 is a flow chart illustrating steps of an embodiment of a method of the invention.

In use, an embodiment of the method 111 of assembling the enclosed slide 20 having a predetermined configuration and extending between the deck 22 and the ground surface 24 includes the following steps (FIG. 14). First, a number of elongate sections 36 are provided (step 113). Preferably, the slide 20 includes the top section 84 (FIGS. 1, 10), the bottom section 86 (FIGS. 1, 11), and the connecting sections 88 positioned therebetween, on assembly. As described above, each section 36 includes the body 42 extending between the first end and the second end thereof. Each of the flanges 44 is positioned substantially at one of the ends of each section.

Instructions for assembling the sections into abutting end-to-end relations to form the predetermined configuration are provided (step 115).

Next, the sections 36 are positioned in the abutting end-to-end relations respectively in accordance with such instructions (step 117). In practice, it is preferred that the bottom section 86 is first positioned relative to the deck, so that the connecting sections 88 are added as the slide is built up from the bottom section 86, i.e., each subsequent section being positioned on the immediately preceding section. Preferably, the sections are positioned in each case so that the flanges 44 positioned at each of the abutting two ends of respective sections comprise the pair 47 of the flanges which are positioned adjacent to each other. The notched edges 46 on each pair 47 of adjacent flanges preferably are then aligned (step 119). It is also preferred that such alignment is achieved by rotation of an abutting section relative to the other section abutting thereto.

For instance, the two abutting sections shown in FIGS. 2 and 2A (designated 36A and 36B for convenience) are positioned abutting each other, before the clamp ring 48 is positioned on the pair 47 of flanges. For convenience, the flange on section 36A is designated 44A, and the flange on section 36B is designated 44B (FIG. 2A). As can be seen in FIG. 2A, the teeth and the troughs therebetween on one of the flanges preferably are aligned (i.e., along axes "X" and "Y" indicated in FIG. 2A).

In the next step, the clamp rings 48 are provided, and positioned on the pairs of flanges (step 121). The clamp rings 48 are for securing each flange in the pair 47 of flanges to the other (i.e., adjacent) flange of the pair 47. As described above, each clamp ring 48 includes one or more notched portions 50 for mating with the notched edges 46 of each pair 47 of adjacent flanges respectively.

Preferably, the locking mechanisms 64 in the clamp ring 48 are unlocked when the clamp ring is first positioned on the pair 47 of flanges, so that each of the body segments 52 is loosely positionable on the pair 47 of adjacent flanges. It is also preferred that relative movement of an abutting section (i.e., relative to the section(s) abutting thereto) is permitted, while the locking mechanisms are unlocked. Accordingly, after the clamp ring 48 is loosely positioned on the pair 47 of adjacent flanges, one of the abutting sections is rotatable relative to the other abutting section (i.e., in the directions indicated by arrow "A" in FIG. 2) so that the abutting sections are aligned as preferred before the locking mechanisms 64 on the clamp ring 48 are locked (step 123). (It will be understood that the rotation of an abutting section after the clamp ring has been loosely positioned on the pair 47 is not needed if the abutting sections are aligned as desired before the clamp ring is positioned on the pair.)

Ultimately, each clamp ring 48 is positioned on each pair 47 of adjacent flanges respectively, as described above, so that the notched edges 46 mate with the notched portion 50 in each clamp ring 48 respectively, as described above. In this way, the clamp rings 48 locate each pair 47 of flanges in a predetermined aligned relationship relative to each other.

Preferably, the notched portion 50 of each clamp ring 48 is locked with the notched edges 46 of each pair 47 of adjacent flanges respectively (step 125). As described above, this is preferably achieved by means of locking one or more locking mechanisms 64 which are provided in each clamp ring 48.

As described above, the sections preferably include indicators 68 positioned thereon, to facilitate positioning of each section relative to an abutting section, e.g., in accordance with the instructions, to result in the predetermined configuration. For instance, in FIGS. 12 and 13, indicators 68A and 68B are shown aligned with each other, as are indicators 68C and 68D. It can be seen in FIG. 2A that the user can readily position the abutting sections as desired to achieve the predetermined configuration by aligning the respective indicators.

Additional embodiments of the invention are illustrated in FIGS. 16A-19. In FIGS. 16A-19, elements are numbered so as to correspond to like elements illustrated in FIGS. 1-15B.

Figure 16A:
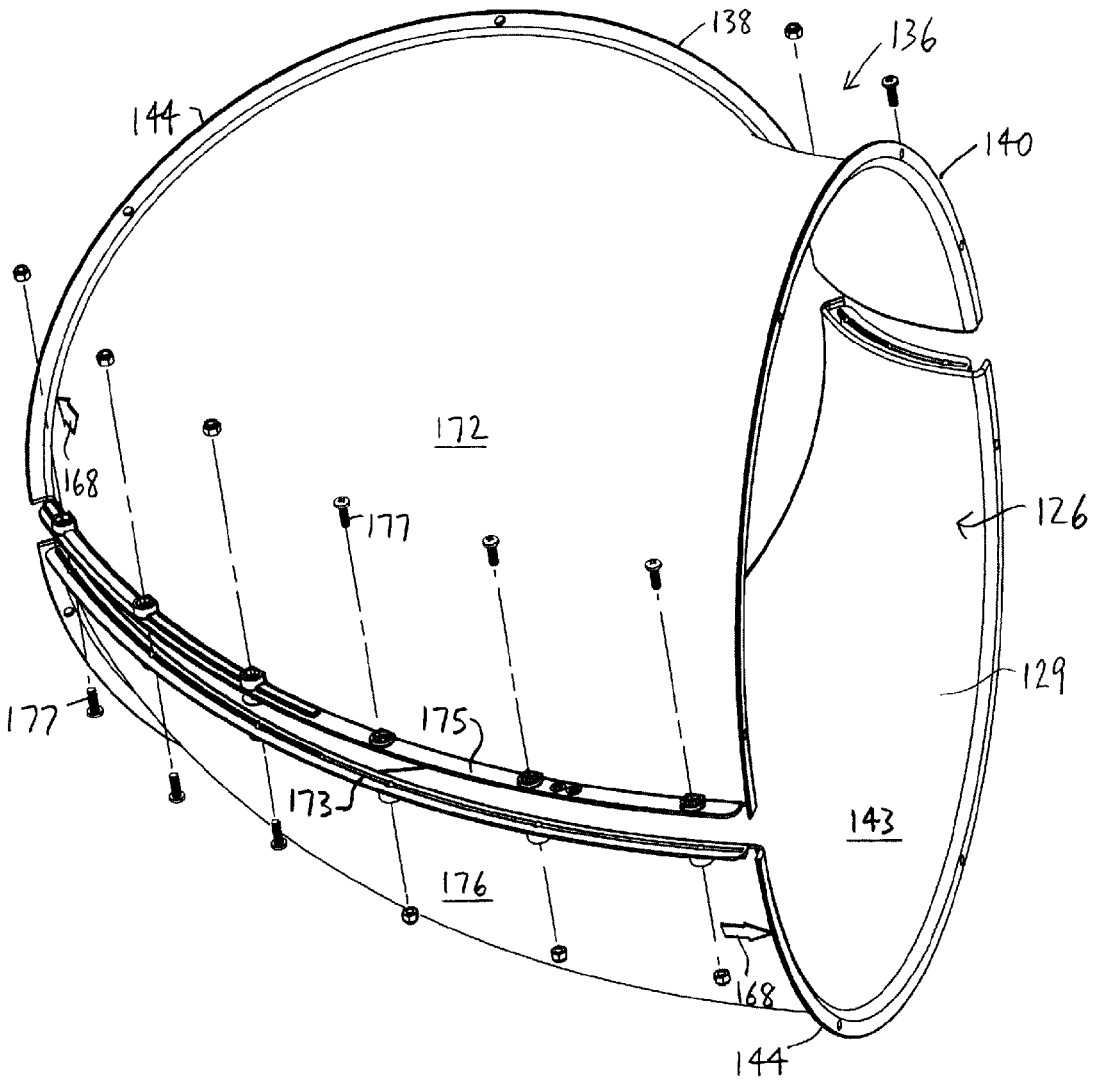
FIG. 16A is an isometric view of an alternative embodiment of a section of the invention, drawn at a smaller scale.
Figure 16B:
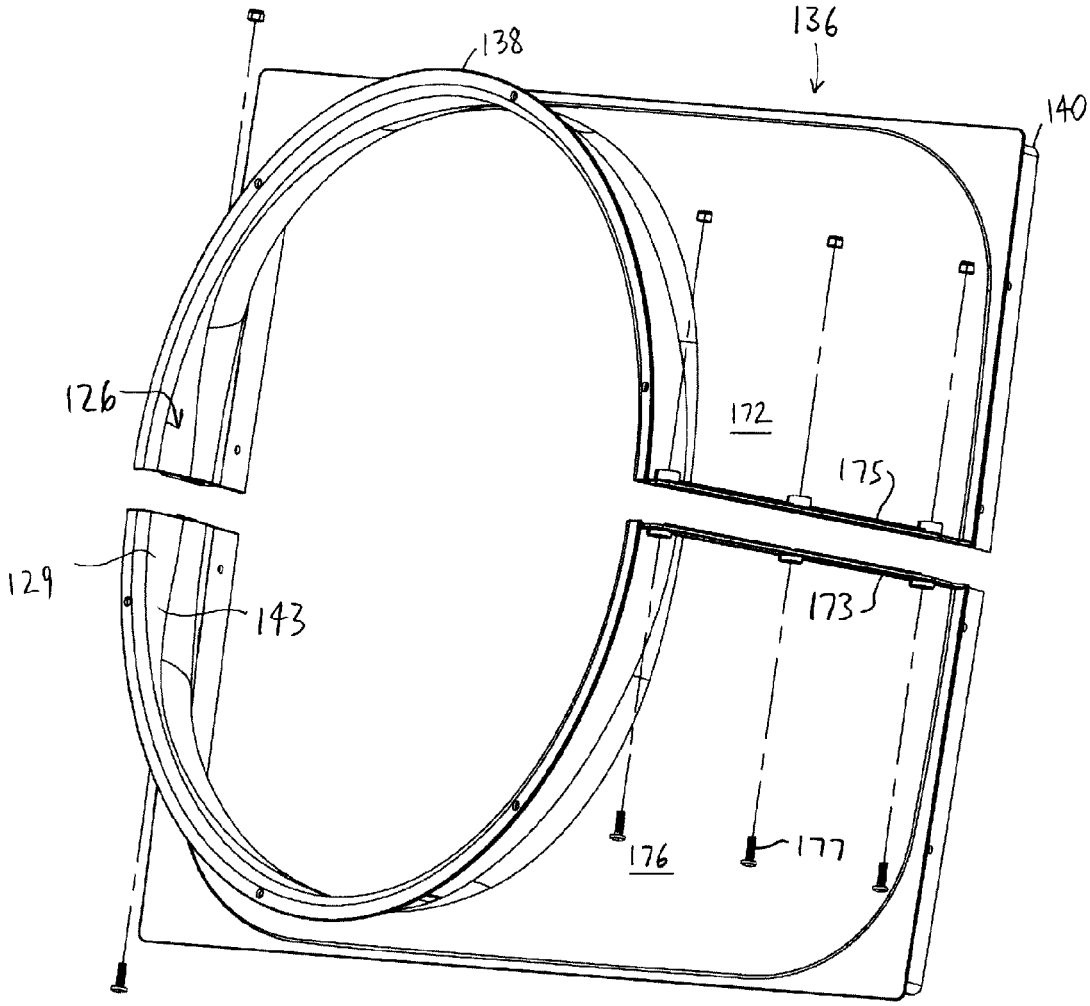
FIG. 16B is an isometric view of an embodiment of a top section of the invention.
Figure 16C:
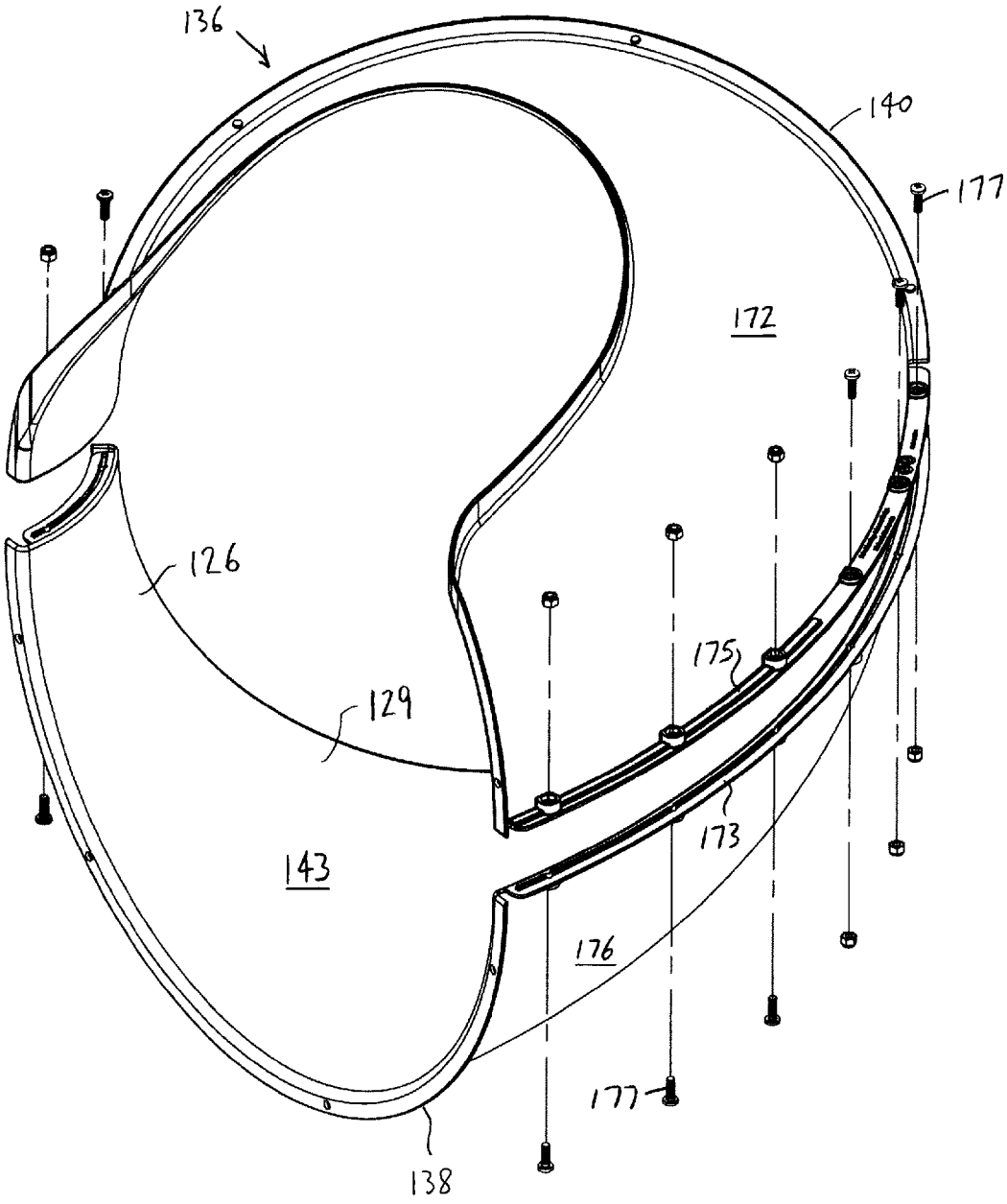
FIG. 16C is an isometric view of an embodiment of another section of the invention.
Figure 16D:
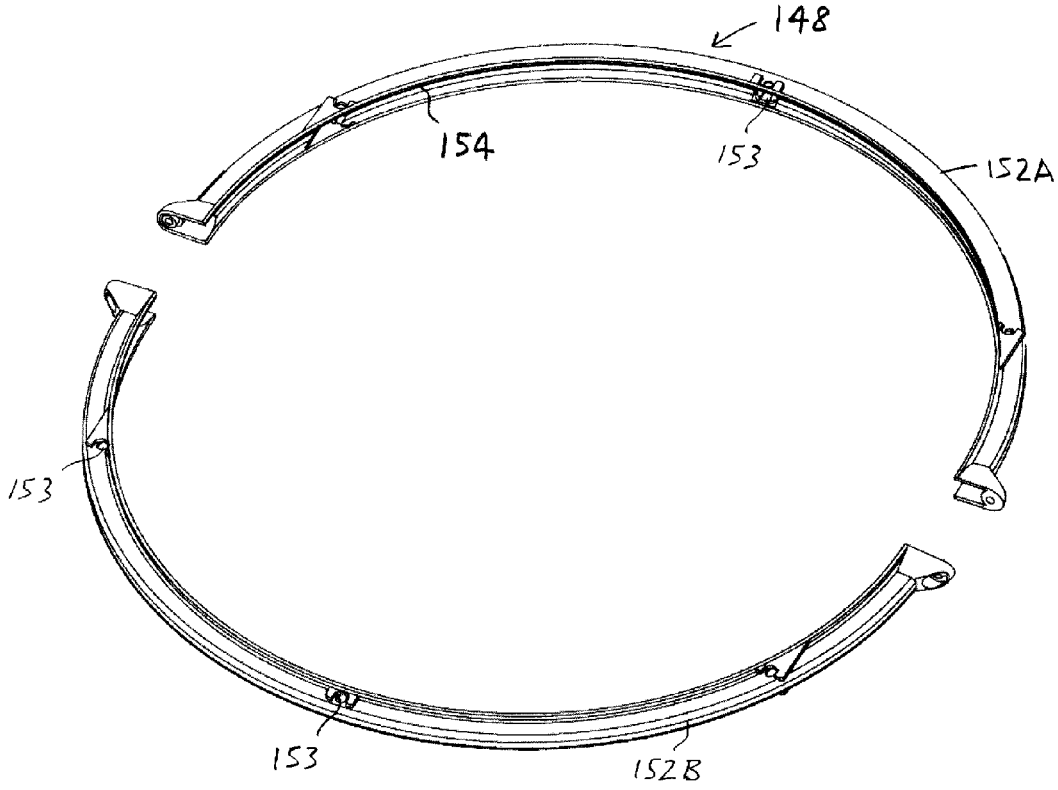
FIG. 16D is an isometric view of an alternative embodiment of a clamp ring of the invention (with locking mechanisms omitted), drawn at a larger scale.
Figure 19:
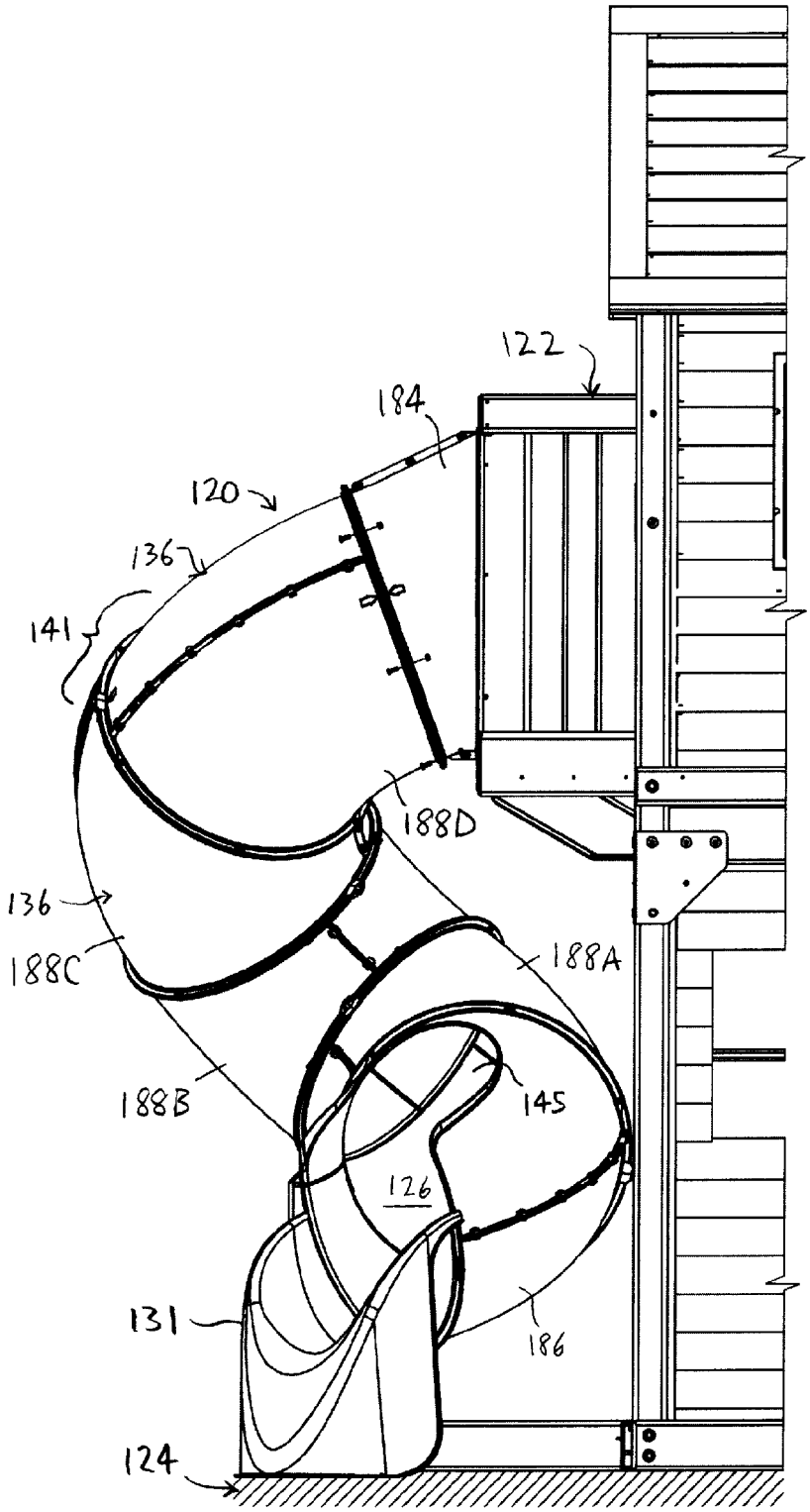
FIG. 19 is a side view of an embodiment of the enclosed slide of the invention with the sections thereof in the predetermined configuration, drawn at a smaller scale.

In another embodiment, the enclosed slide 120 of the invention preferably includes a number of elongate sections 136 at least partially defining an elongate slide bed 126. (FIG. 19) Each section 136 preferably extends between a first end 138 and a second end 140 thereof (FIGS. 16A-16C). As can be seen in FIG. 19, the sections 136 preferably are connected together in abutting end-to-end relations respectively in a predetermined configuration in which selected pairs 141 of the sections 136 are positioned end-to-end in preselected positions relative to each other respectively, as will be described. Preferably, each section 136 includes a body 142 defining at least a part 143 of the slide bed 126 and one or more flanges 144 extending outwardly from the body 142 and positioned substantially at one or more of the ends 138, 140 (FIG. 16A). The flanges 144 positioned at each of the abutting two ends of the sections 136 in each selected pair 141 preferably form a pair 147 of flanges 144 which are positionable adjacent to each other (FIGS. 17C, 17F). It is also preferred that each adjacent flange 144 in each pair 147 of adjacent flanges 144 includes a number of flange holes 151 substantially aligned with each other when the elected pair 141 of the sections 136 which includes the pair 147 of the adjacent flanges 144 are in the preselected positions therefor (FIG. 17C). Preferably, the enclosed slide 120 also includes a number of clamp rings 148 (FIG. 16D) adapted for securing the adjacent flanges 144 in each selected pair 141 of sections 136 to each other respectively. As can be seen in FIGS. 17E and 17F, each pair 147 of adjacent flanges 144 preferably is at least partially receivable in each clamp ring 148 respectively, as will also be described. In addition, each clamp ring 148 preferably includes a number of clamp ring holes 153 (FIG. 16D) substantially alignable with the flange holes 151 in the pair 147 of adjacent flanges 144 respectively, when the selected pair 141 of the sections 136 which include the pair 147 of the adjacent flanges 144 are in the preselected positions therefor (FIGS. 17D, 17E). It is also preferred that the enclosed slide 120 includes a number of fasteners 155 at least partially positionable in the flange holes 151 and in the clamp ring holes 153 upon alignment thereof, to at least partially fasten the clamp rings 148 respectively to the adjacent flanges 144 at least partially received therein, thereby securing together the selected pair 141 of the sections 136 on which the pair 147 of the adjacent flanges 144 are located in the preselected positions therefor (FIGS. 17D-17F).

As can be seen, for example, in FIGS. 17D-17F and 16D, each clamp ring 148 preferably includes one or more body segments 152 defining one or more slots 154 in which a pair 147 of adjacent flanges 144 is at least partially receivable. (The two body segments are identified as 152A and 152B in FIG. 16D.) The body segments 152 in a particular clamp ring preferably are positioned in end-to-end relation to each other when fastened to the pair 147 of the adjacent flanges 144 (FIGS. 17B, 17E). Preferably, each clamp ring 148 includes one or more locking mechanisms 164 for locking the body segments 152 together in end-to-end relation, to at least partially hold each clamp ring 148 on each pair 147 of adjacent flanges 144 respectively (FIG. 17B). It will be understood that the locking mechanisms are omitted from FIG. 16D for clarity of illustration.

As illustrated in FIG. 17F, it is also preferred that, when the selected pair 141 of sections 136 are located in the preselected positions relative to each other, the pair 147 of the adjacent flanges 144 located thereon are substantially engaged with each other in a side-by-side relation to each other (FIG. 17E).

Preferably, and as can be seen in FIG. 19, the sections 136 include a top section 184, a bottom section 186, and a number of connecting sections 188 adapted to be positioned end-to-end for connecting the top and bottom sections 184, 186, to form the predetermined configuration. For clarity of illustration, the connecting sections 188 are individually identified as 188A-188D in FIGS. 19 and 17A. The sections are shown in the predetermined configuration in both of FIGS. 17A and 19, except that the top section 184 is omitted from FIG. 17A for clarity of illustration.

It is also preferred that, when the sections 136 are connected together in the predetermined configuration, the slide bed 126 extends between the top and bottom sections 184, 186. The sections 136 preferably include the parts 143 of the slide bed 126 adapted to cooperate with each other, when the sections 136 are connected together in the predetermined configuration, to form the slide bed 126. It is also preferred that the slide bed 126 includes a number of the substantially smooth surfaces 129 (i.e., included in the parts 143 in each section 136 respectively) in each section 136 which are respectively positioned to mate with each other, when the sections are connected together in the predetermined configuration, so that the smooth surfaces 129 in each section collectively form a substantially continuous surface of the slide bed.

In one embodiment, as shown in FIGS. 18A-18D and 19, the enclosed slide 120 preferably includes a bottom extension portion 131, for connection to the bottom section 186. The bottom extension portion 131 preferably includes a part 133 thereof with a substantially smooth surface 163 adapted to cooperate with the part 143 of the slide bed 126 in the bottom section 186, to provide a substantially continuous surface (i.e., throughout the bottom section 186 and the bottom extension portion 131), when the bottom extension portion 131 and the bottom section 186 are connected together. The bottom extension portion 131 preferably provides a transition between the bottom section 186 and a ground surface 124 (FIG. 19), or such other surface as may at least partially support (i.e., directly or indirectly) the bottom section 186. It will be understood that, depending on the predetermined configuration, the bottom extension portion 131 may be provided in a variety of forms.

Figure 18A:
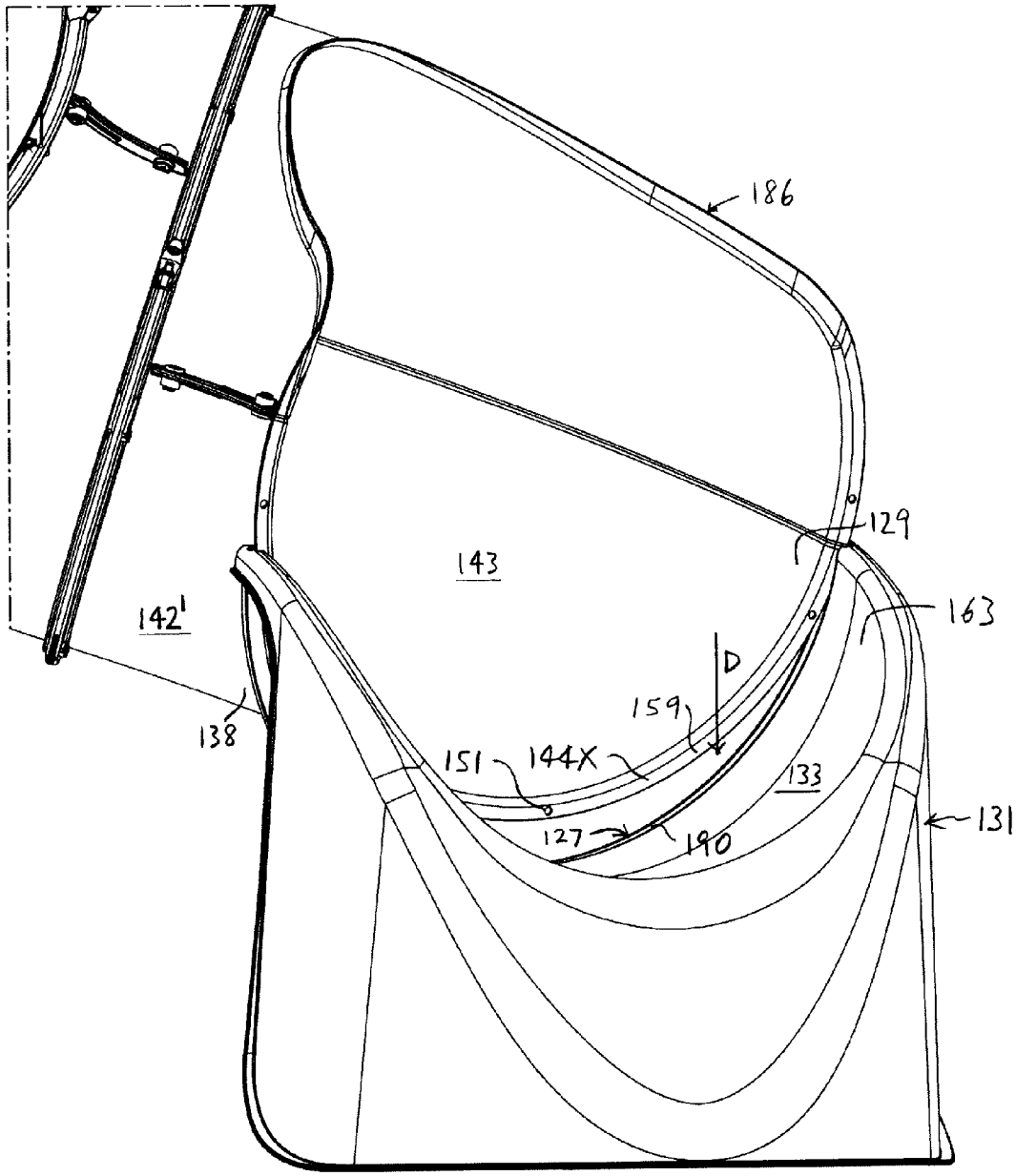
FIG. 18A is an isometric view of embodiments of a bottom extension portion and a bottom section of the invention with part of a flange on the bottom section positioned to be inserted in a slot in the bottom extension portion, drawn at a smaller scale.
Figure 18B:
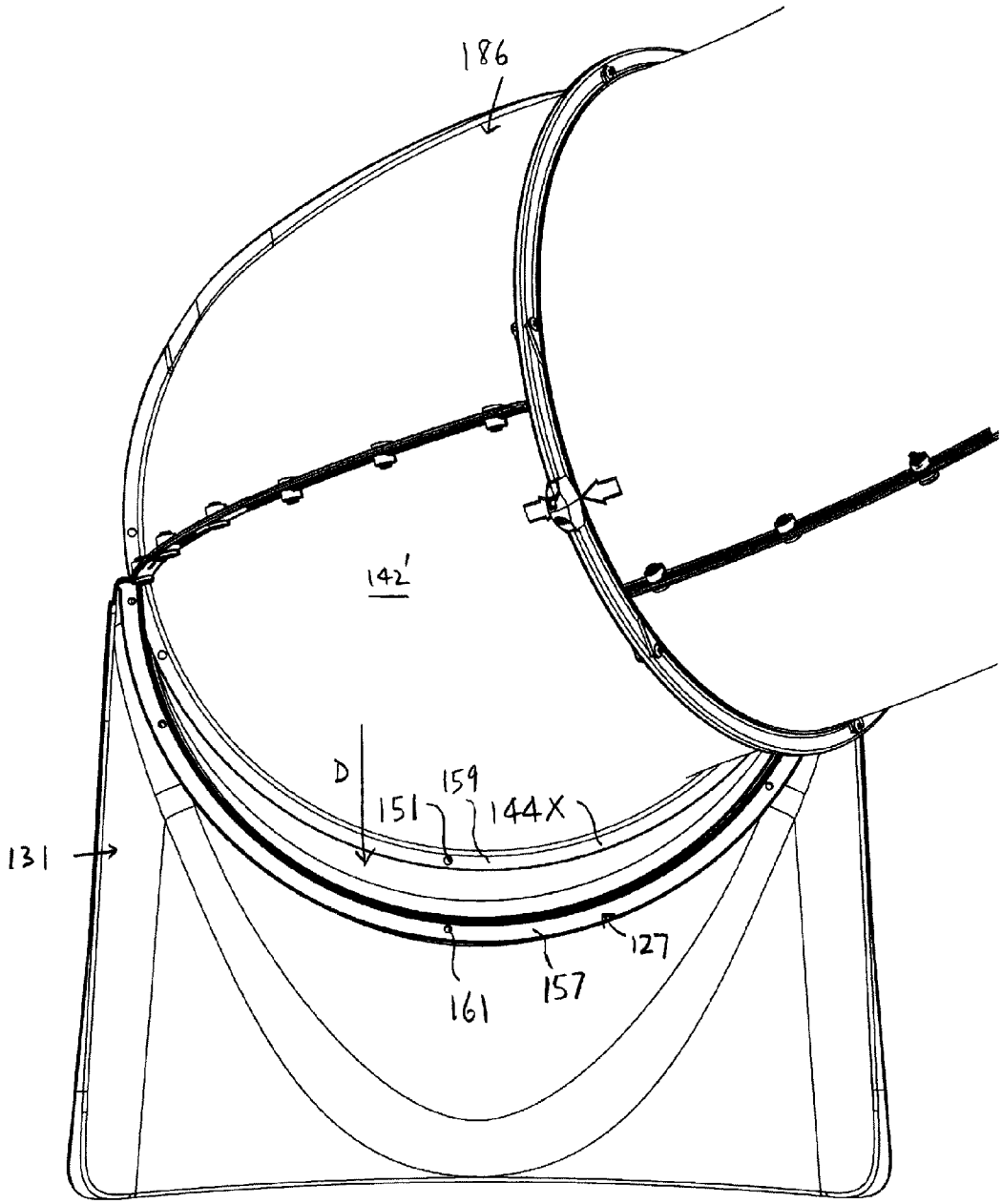
FIG. 18B is a rear view of the bottom extension portion of FIG. 18A and the bottom section of FIG. 18A.
Figure 18C:
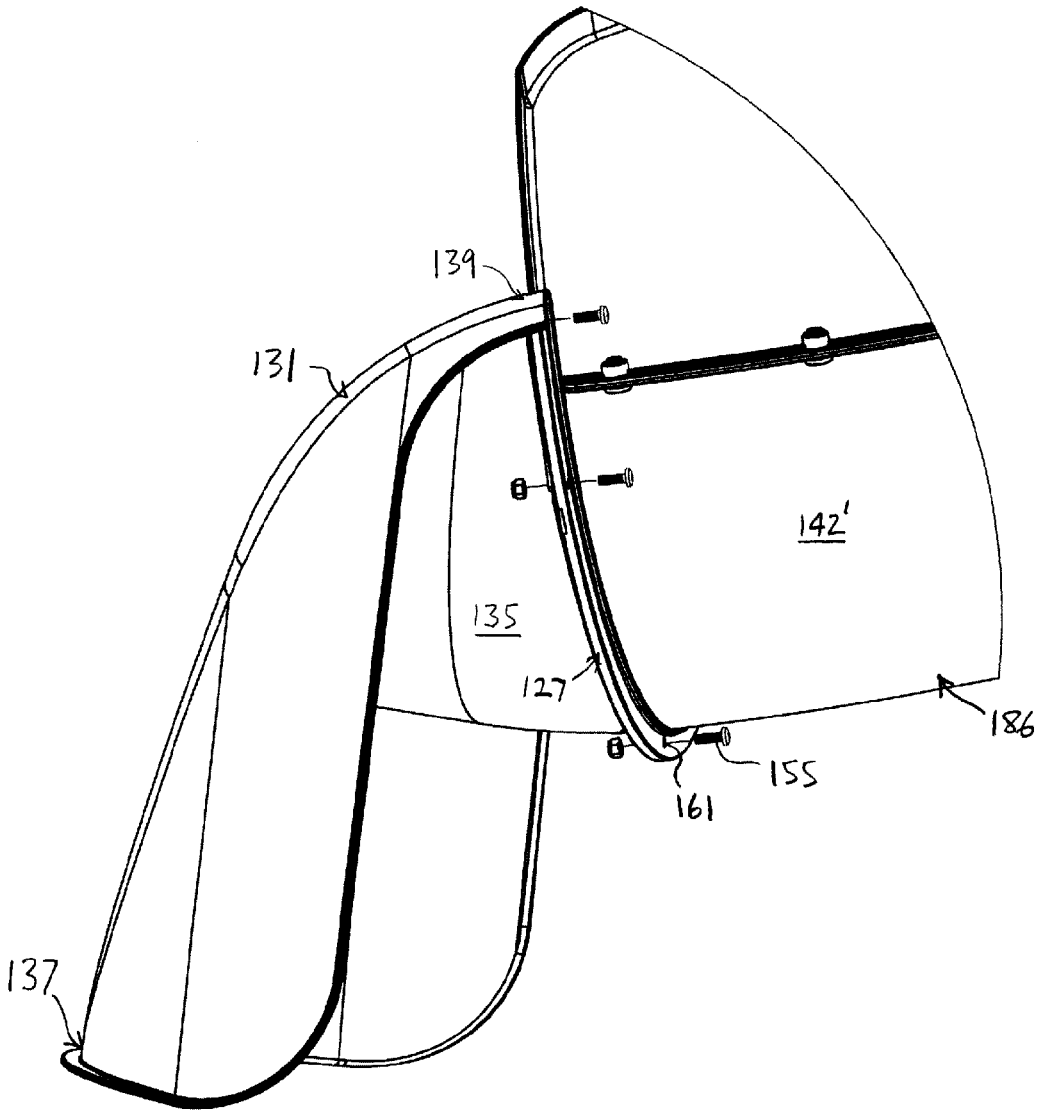
FIG. 18C is another isometric view of the bottom extension portion and the bottom section of FIG. 18A, with part of the flange on the bottom section received in the slot in the bottom extension portion.
Figure 18D:
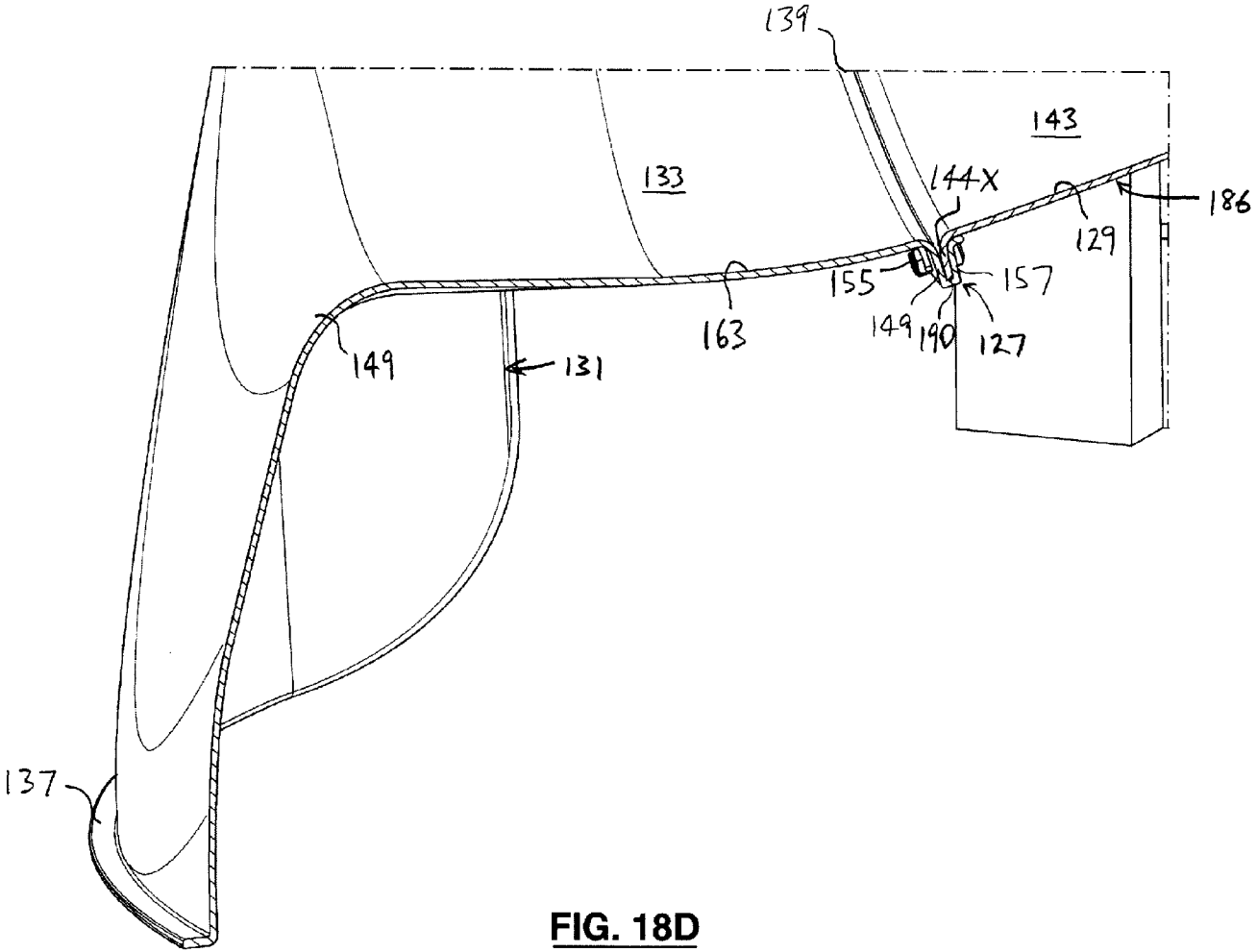
FIG. 18D is a cross-section of the bottom extension portion and part of the bottom section of FIG. 18C connected together, drawn at a larger scale.

For instance, as illustrated in FIG. 18C, in one embodiment, the bottom extension portion 131 preferably includes a body 135 extending between ends 137, 139 thereof. Preferably, the bottom extension portion 131 includes a body segment 127 positioned at the end 139 having two walls 149, 157 which define a slot 190 (FIG. 18D). As can be seen in FIGS. 18A-18D, a part 159 of the flange at the end 138 of the bottom section 186 (such flange being identified as 144X in FIGS. 18A-18D for clarity) is receivable in the slot 190.

Preferably, the walls 149, 157 include holes 161 which are aligned with the flange holes 151 in the flange 144X when the surfaces 163 (of the bottom extension portion 131) and 129 (of the bottom section 186) are substantially aligned. As can be seen in FIGS. 18C and 18D, when the bottom extension portion 131 and the bottom section 186 are in a design position relative to each other (i.e., when the part 159 of the flange 144X is positioned in the slot 190 so that the flange holes 151 are substantially aligned with the holes 161), the fasteners are insertable in the holes 151, 161. Once the holes 161 and the flange holes 151 are aligned, the fasteners 155 are at least partially inserted through the holes 151, 161 and then tightened, to fasten together the body segment 127 and the part 159 of the flange 144X.

The bottom extension portion 131 preferably is connected to the bottom section 186 after the sections 136 have been connected together to form the predetermined configuration. As can be seen in FIGS. 18A, 18B, once the sections 136 are connected together in the predetermined configuration, and preferably after the top section 184 is connected to a structural support (e.g., the deck 122), the bottom extension portion 131 is positioned with the slot 190 substantially below the part 159 of the flange 144X, and with the end 137 of the bottom extension portion 131 positioned on the ground 124 (FIGS. 18A, 18B). The end 138 of the bottom section 186 is then lowered (i.e., moved in the direction indicated by arrow "D" in FIGS. 18A and 18B) until the part 159 of the flange 144X is positioned in the slot 190. Because the bottom extension portion 131 and the bottom section 186 are then in the design position relative to each other, the holes 151, 161 are substantially aligned, and the fasteners 155 are then at least partially inserted in the holes 151, 161. Once the fasteners 155 are at least partially inserted in the holes 151, 161 (FIG. 18C), they are tightened.

As can be seen in FIG. 18D, once the bottom extension portion 131 and the bottom section 186 are fastened together, the part 143 of the slide bed 126 in the bottom section 186 is substantially aligned with the part 133 of the bottom extension portion 131, so that the substantially smooth surface 129 of the part 143 is substantially aligned with the surface 163 of the part 133. Also, the surfaces 129, 163 form a substantially continuous sliding surface. At the other end 137, the smooth part 133 effectively provides an extension of the slide bed 126 to a terminal part 149 (FIG. 18D) located a distance above the ground surface 124. Those skilled in the art will appreciate that the bottom extension portion 131 shown in the drawings is only one of many different arrangements that may be used. The bottom extension portion 131 has the benefit that, when the user travels down the slide bed 126 feet first, upon the user reaching the bottom extension 131, the user's legs may be located past the terminal part 149 (i.e., bent at the knees), so that the user may comfortably sit up at that point. Preferably, the end 137 rests directly on the ground surface 124, and the other end 139 is supported by the bottom section 186.

Preferably, the enclosed slide includes one or more indicators 168 positioned on the body 142 of each section 136 respectively, for locating each section 136 in each selected pair 141 relative to each other in the preselected positions therefor. Preferably, the sections 136 in each selected pair 141 are in the preselected positions relative to each other with each of the indicators 168 on the sections 136 in the selected pair 141 are substantially aligned with each other respectively.

As noted above, once the sections 136 of the enclosed slide 120 are connected (FIGS. 17A, 19), the sections 136 are in the predetermined configuration. Preferably, upon assembly, the top section 184 is secured to a deck 122 or other suitable structure, and the bottom section 186 is positioned proximal to the ground surface 124. The bottom extension portion 131 is positioned on the ground 124 and attached to the bottom section 186, and at least partially supports the bottom section 186 (and therefore the sections 136).

In use, to assemble the enclosed slide 120, selected pairs 141 of the sections 136 preferably are located, by a worker or assembler (not shown), in the predetermined positions relative to each other. Preferably, this is done by aligning the indicators 168 on the respective bodies 142 of the sections 136 in each selected pair 141. In FIGS. 17C-17F, the sections in the selected pair 141 illustrated are designated 136A and 136B for convenience. As shown in FIG. 17C the sections 136A, 136B are positioned end-to-end, so that the flanges 144A, 144B thereon are the pair 147 of flanges adjacent to each other. The sections 136A, 136B preferably are relatively lightweight, and may relatively easily be supported and rotated by the assembler, i.e., in the directions indicated by arrows "$C_1$" and "$C_2$" in FIG. 17C, until the indicators 168A, 168B are substantially aligned. In FIG. 17C, the sections 136A, 136B are shown located in the predetermined position relative to each other, because the indicators 168A, 168B on the bodies 142A, 142B respectively are substantially aligned.

As can be seen in FIG. 17D, in the next step, a selected one of the body segments (identified for convenience in FIG. 17D by reference numeral 152A) of the clamp ring 148 preferably is positioned on part of the pair 147 of adjacent flanges 144A, 144B so that an end 102 of the body segment 152A is substantially aligned with the indicators 168A, 168B. When the end of the first body segment 152A is substantially aligned with the indicators 168A, 168B, the clamp ring holes 153 are substantially aligned respectively with the flange holes 151 in the part of the pair 147 of adjacent flanges 144A, 144B at least partially received in the first body segment 152A. As will be described, a part of the locking mechanism 164 is located at the end 102 of the first body segment 152A.

Preferably, one or more fasteners 155 are positioned at least partially in the clamp ring holes 153 in the first body segment 152A and in the flange holes 151 substantially aligned therewith. In FIG. 17D, the fastener 155 illustrated includes a bolt and a nut. However, as will be appreciated by those skilled in the art, any suitable fasteners may be used. As described above, the fasteners 155 at least partially fasten together the first body segment 152A and the part of the adjacent flanges 144A, 144B received therein together. Accordingly, once the fasteners 155 are at least partially in the clamp ring holes 153 of the first body segment 152A and the flange holes 151, and the fasteners 155 are tightened (i.e., in the example shown, the nut is tightened on the bolt), the sections 136A, 136B are then at least partially partially fastened together.

Next, a second body segment (designated 152B in FIG. 17E for convenience) is positioned on the remaining part of the pair 147 of adjacent flanges 144A, 144B. Preferably, the clamp ring 148 includes only two body segments. However, those skilled in the art will appreciate that the clamp ring 148 may include any suitable number of body segments.

Preferably, an end 104 of the second body segment 152B is substantially aligned with the indicators 168A, 168B. As can be seen in FIG. 17E, when the second body segment 152B is substantially aligned with the indicators 168A, 168B, the ends 102, 104 of the first and second body segments 152A, 152B are proximal to each other, and the locking mechanism 164 is movable to the engaged condition. Once the second body segment 152B is positioned on the flanges 144A, 144B and the locking mechanism 164 is engaged, the body segments 152A, 152B are locked together in end-to-end relation, to at least partially hold the clamp ring 148 on the pair 147 of adjacent flanges 144A, 144B. In addition, the fasteners 155 are at least partially positioned in the clamp ring holes 153 of the second body segment 152B and the flange holes 151 substantially aligned therewith, to fasten the second body segment 152B and the adjacent flanges 144A, 144B together.

It will be understood that each of the first and second body segments 152A, 152B has another end (not shown in FIGS. 17D, 17E), and that when the body segments 152A, 152B are positioned on the pair 147 of adjacent flanges 144A, 144B as shown in FIG. 17D, such other ends of the body segments 152A, 152B are positioned proximal to each other, on the opposite side of the sections 136A, 136B. Such other ends are also preferably secured together by another locking mechanism. The other ends and locking mechanism are the same as the ends 102, 104 and the locking mechanism 164 in all material respects, and accordingly the other ends and the locking mechanism located thereat are not illustrated, in order to simplify the drawings.

Also, it will be understood that additional indicators (not shown in FIGS. 17A-17E) are positioned on the bodies 142A, 142B, to facilitate locating the sections 136A, 136B in the preselected positions, and also to facilitate locating the respective other ends (not shown) of the first and second body segments 152A, 152B. Such additional indicators are identical in all material respects to the indicators 168A, 168B. When the sections 136A, 136B are in the preselected position therefor, the other, additional indicators on each of the respective bodies of the sections 136A, 136B are substantially aligned with each other.

As can be seen in FIGS. 16A-16C, each body 142 of the section 136 preferably is at least partially made up of first and second parts 172, 176 which cooperate with each other, when joined together, to form the body 142. Preferably, the first and second parts 172, 176 include respective ridges 175, 173 which are adapted to mate with each other when the first and second parts 172, 176 are put together (FIG. 16A). It is also preferred that the first and second parts 172, 176 are fastenable together by suitable fasteners 177. For instance, the fastener 177 shown in FIGS. 16A-16C is a nut and bolt.

As described above, the sections 136 include the top section 184, the bottom section 186, and connecting sections 188, the connecting sections being identified in FIG. 19 as 188A-188D. As can be seen in FIGS. 16B and 16C, the top section 184 and the bottom section 186 preferably are also formed when first and second parts thereof are fastened together, in substantially the same fashion as in the connecting sections 188.

It will be understood that the attachment of the sections in each selected pair of sections is repeated until all the sections are connected together, in the predetermined configuration. For instance, as can be seen in FIG. 19, the bottom section 186 and the lowermost connecting section 188A are a selected pair of sections, attachable together in the predetermined positions therefor.

As can be seen in FIG. 19, the uppermost connecting section 188D and the top section 184 form another selected pair of sections. The connecting sections (i.e., 188A-188D) also are included in a number of selected pairs respectively. For example, FIG. 19 also shows that connecting sections 188C and 188D form another selected pair of sections.

Figure 17A:
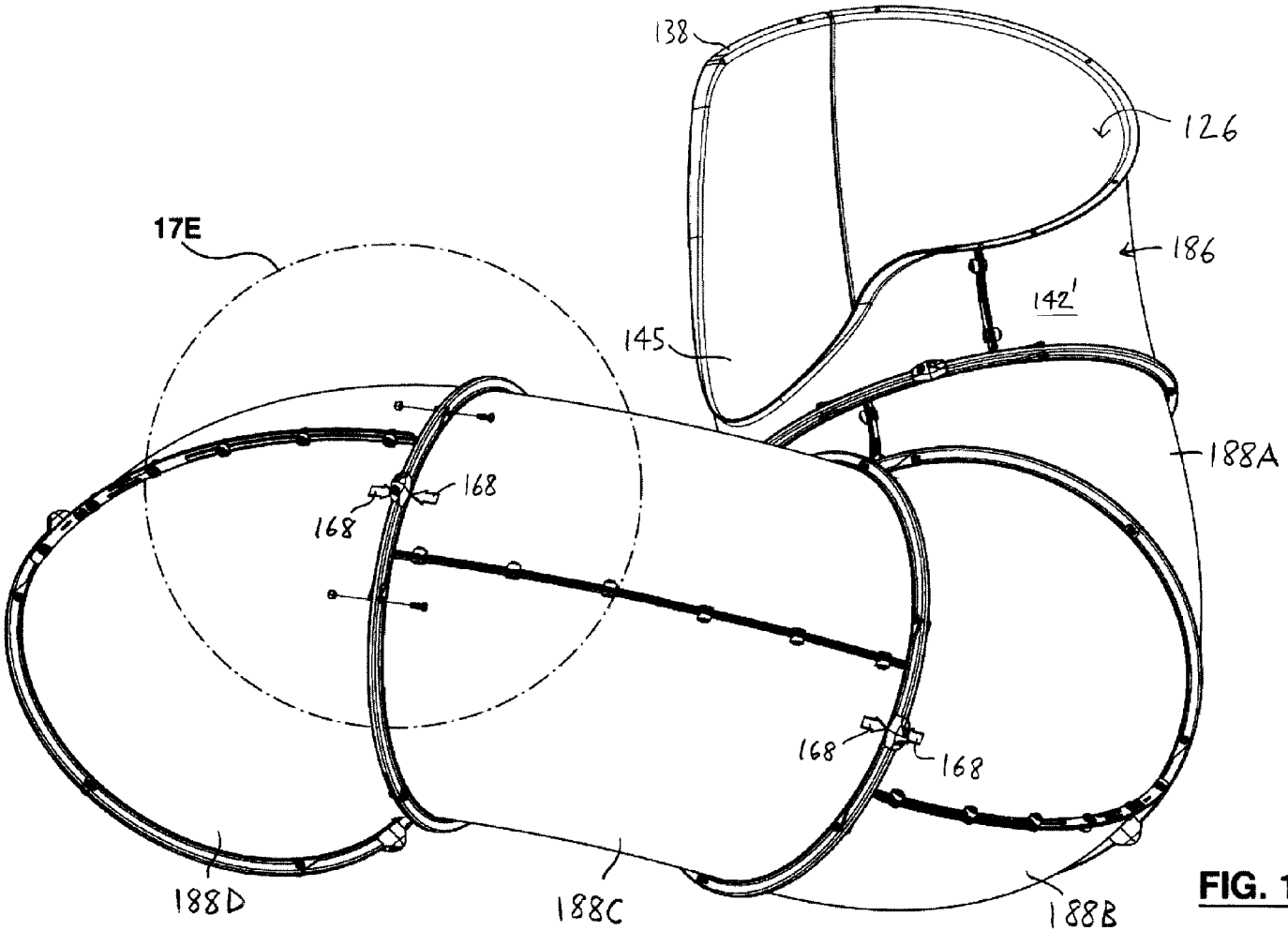
FIG. 17A is an isometric view of a number of sections of the invention connected in a predetermined configuration, drawn at a smaller scale.
Figure 17B:
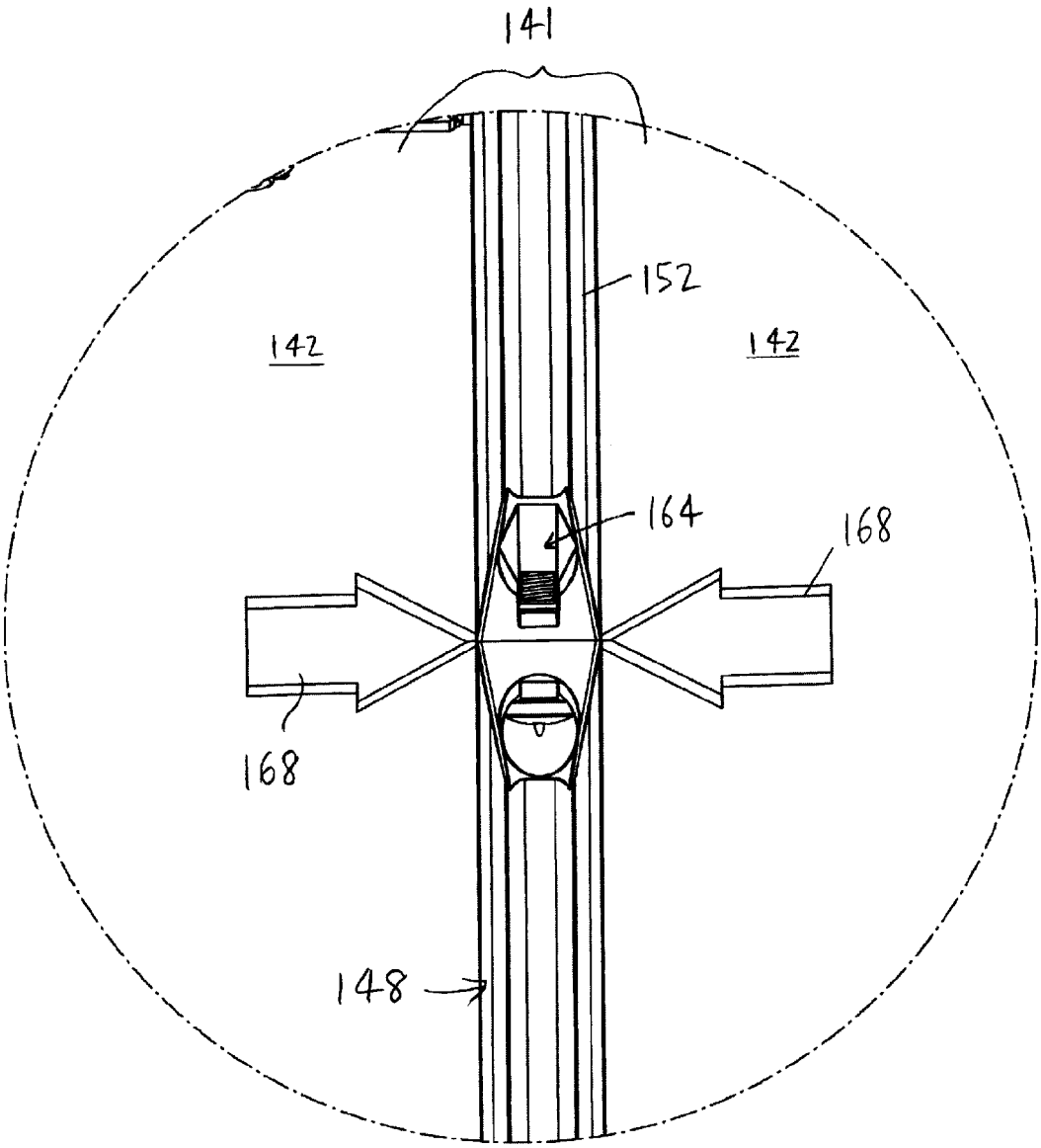
FIG. 17B is a top view of an embodiment of a locking mechanism of the invention, locking body segments of a clamp ring together, drawn at a larger scale.
Figure 17C:
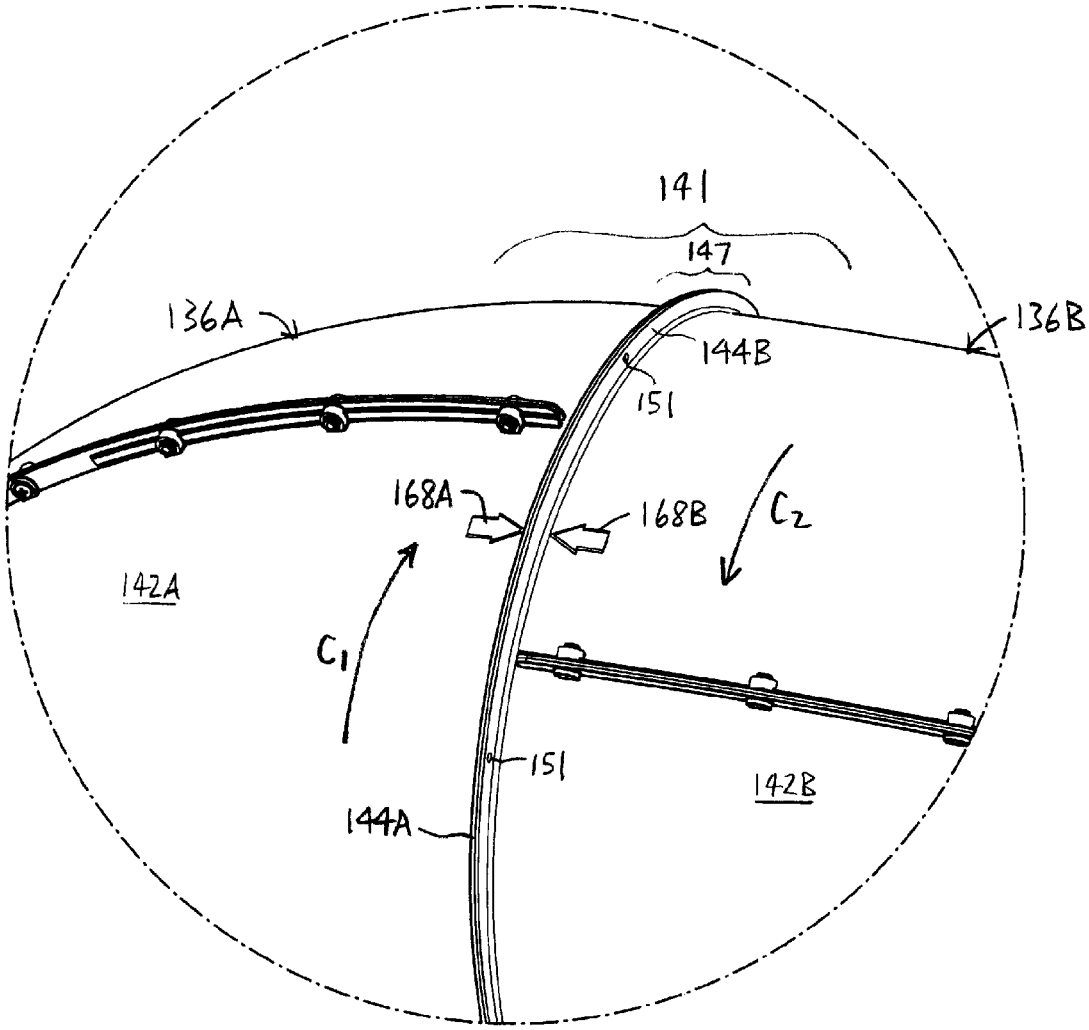
FIG. 17C is an isometric view of a selected pair of sections in a predetermined position therefor, with the flange holes in the pair of adjacent flanges thereof substantially aligned, drawn at a smaller scale.
Figure 17D:
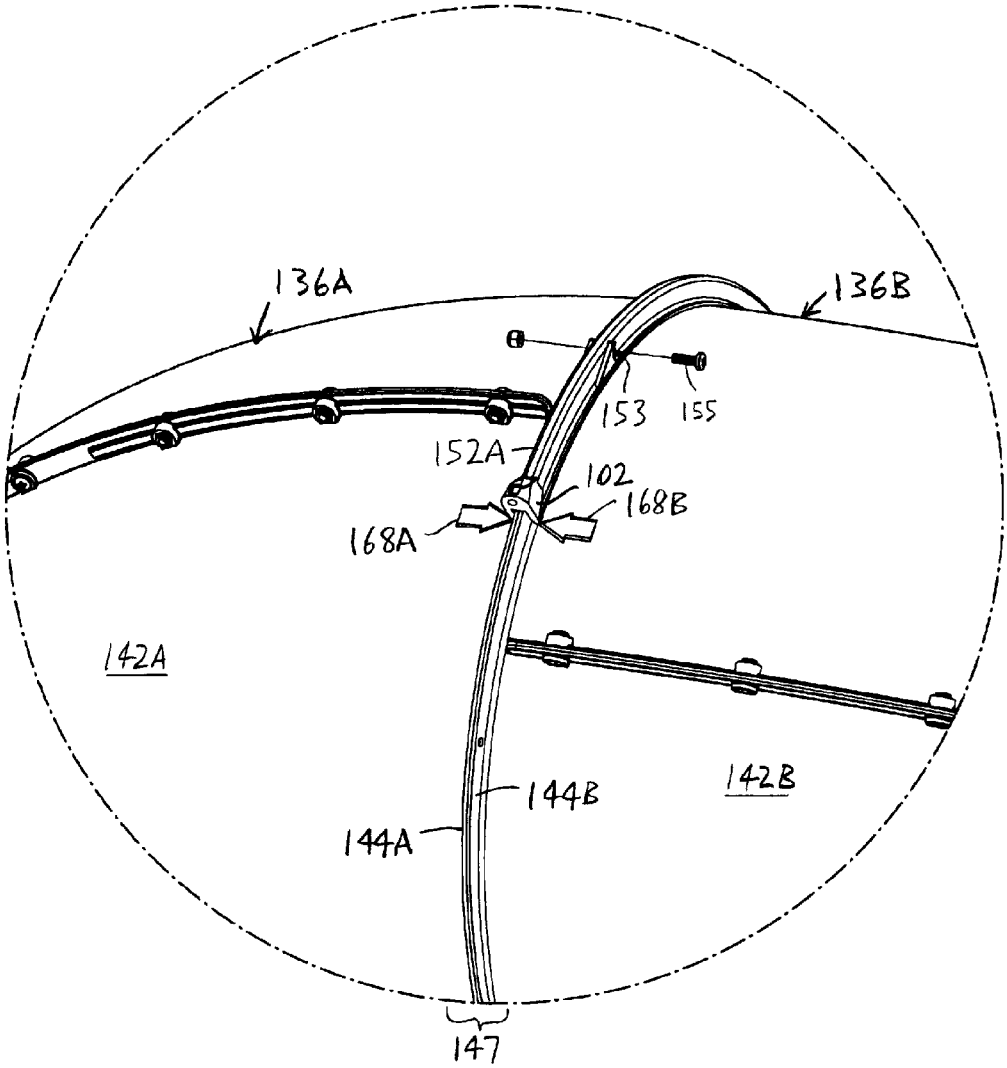
FIG. 17D is an isometric view of the sections of FIG. 17C with a body segment of a clamp ring positioned on the pair of adjacent flanges.
Figure 17E:
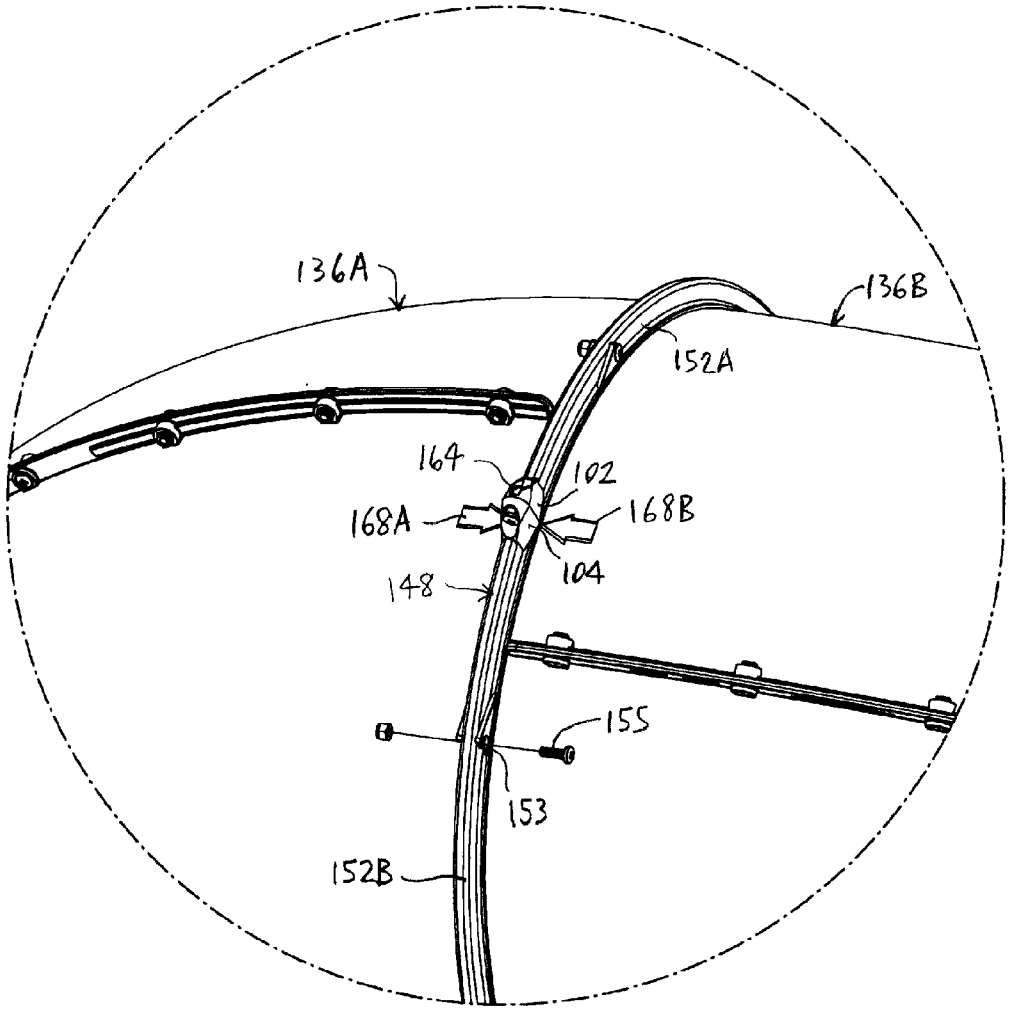
FIG. 17E is an isometric view of the pair of sections of FIG. 17C fastened together, with two body segments of a clamp ring positioned on the pair of adjacent flanges thereof locked together.
Figure 17F:
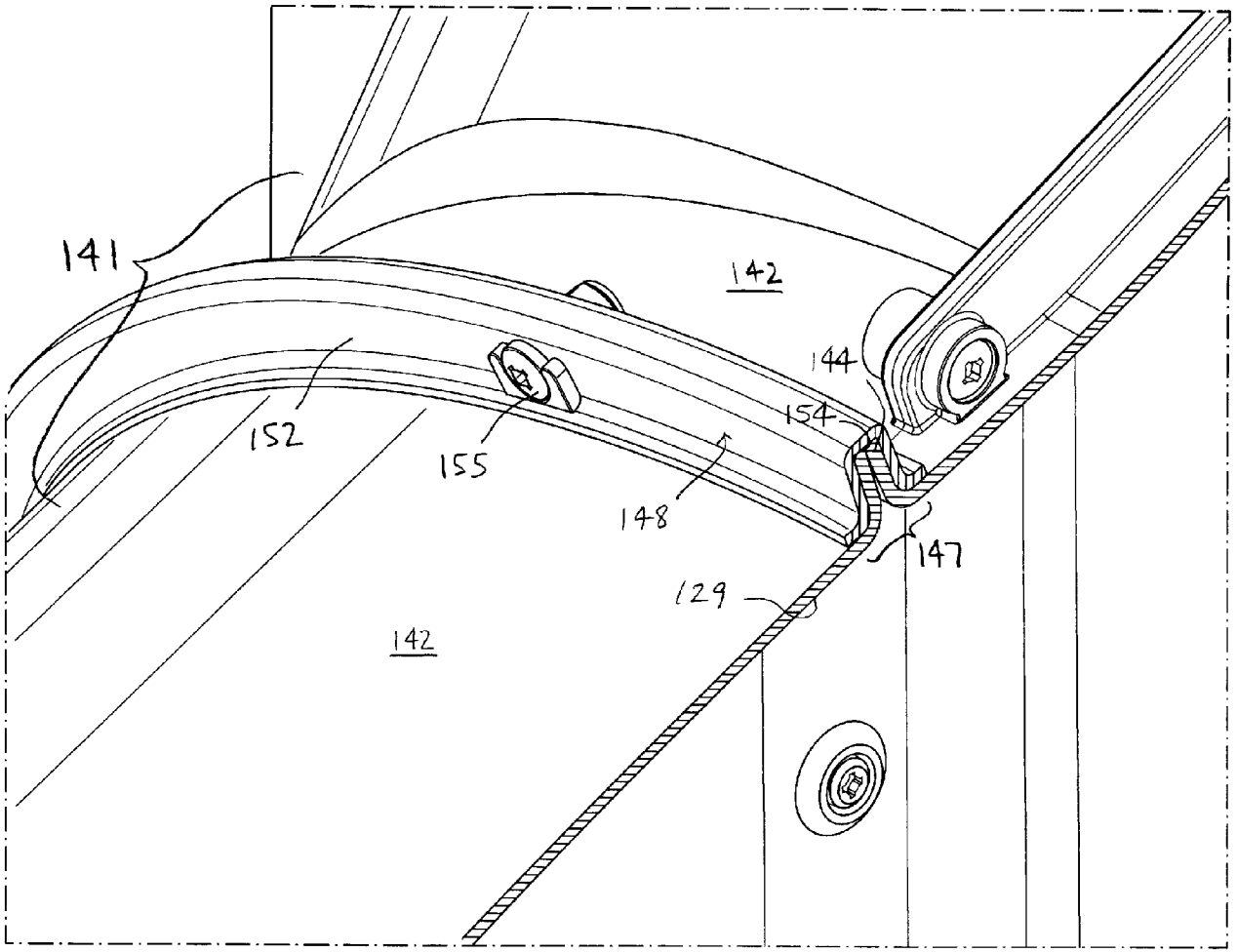
FIG. 17F is partial cross-section of the pair of adjacent flanges at least partially received in the clamp ring, drawn at a larger scale.

The body of the bottom section 186 is identified for convenience in FIGS. 17A and 18A as 142'. As can be seen, e.g., in FIGS. 16C, 17A, and 18A, it is preferred that the body 142' includes an opening 145. The opening 145 is proximal to the end 138 (i.e., the end to which the bottom extension portion 131 is attached), so that the opening 145 enables the slide's user (not shown) to sit up when the user has at least partially passed the end of the slide bed 126. As described above, the user (not shown) who has slid along the slide bed feet first may end with the user's legs past the terminal part 149 (FIG. 18D), i.e., the legs being bent at the knees at about the terminal part 149. When the user is in that position, the opening 145 conveniently allows the user to sit up, and then to exit the enclosed slide 120 from the bottom extension portion 131.

Preferably, the enclosed slide is provided as a kit of parts, in which the elements of the enclosed slide are provided at least partially unassembled, with instructions to enable the assembler (not shown) to assemble the parts into the enclosed slide.

Figure 20:
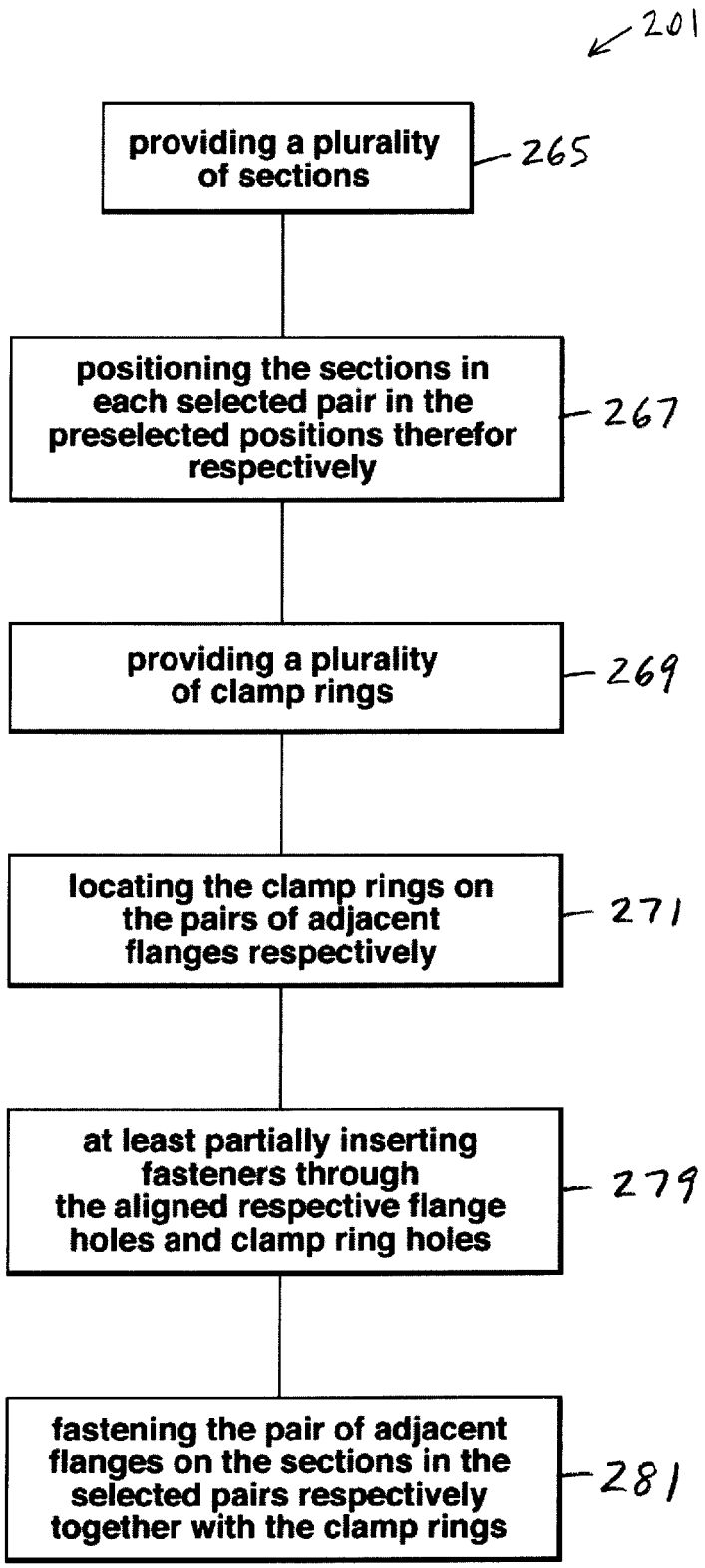
FIG. 20 is a flow chart schematically illustrating an embodiment of a method of the invention.

An embodiment of a method 201 of assembling the slide 120 preferably includes, first, providing a number of the sections 136 (step 265, FIG. 20). The sections 136 in each selected pair 141 are positioned in the preselected positions therefor (step 267). A number of clamp rings 148 are also provided (step 269). The clamp rings 148 are located on the pairs 147 of adjacent flanges 144 respectively (step 271). Fasteners 155 are at least partially inserted through the aligned respective flange holes 151 and clamp ring holes 153 (step 279). The pair 147 of adjacent flanges 144 on the sections 136 in each selected pair 141 are fastened together with the clamp rings 148, by the fasteners (step 281).

It will be appreciated by those skilled in the art that, although steps 265 and 267 are indicated as preceding step 269 in FIG. 20, the sequence of the steps 265 and 267, and step 269, is not functionally significant, i.e., step 269 could precede steps 265 and 267.

Figure 21A:
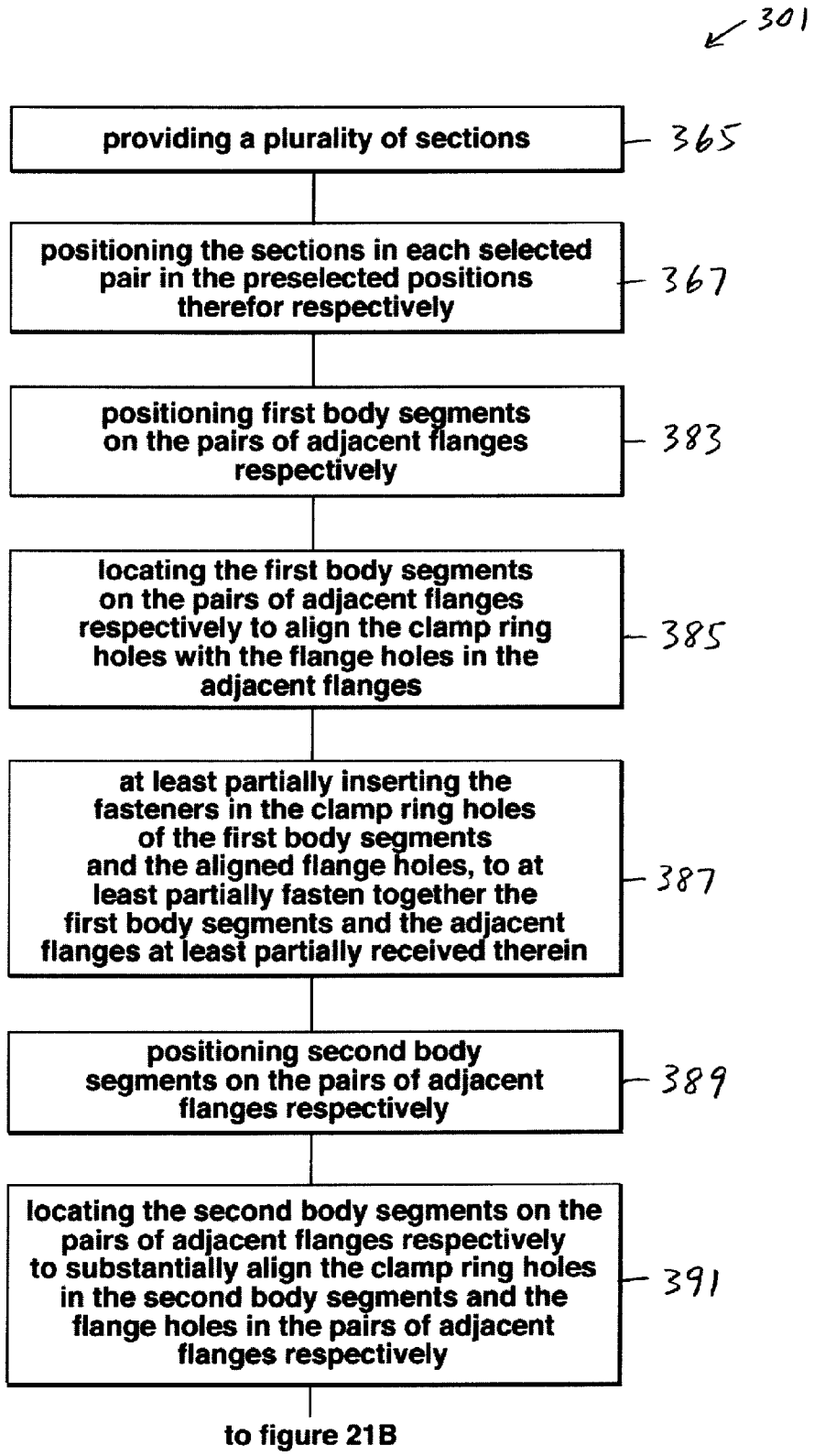
FIG. 21A is a flow chart schematically illustrating a first part of an alternative embodiment of the method of the invention.
Figure 21B:
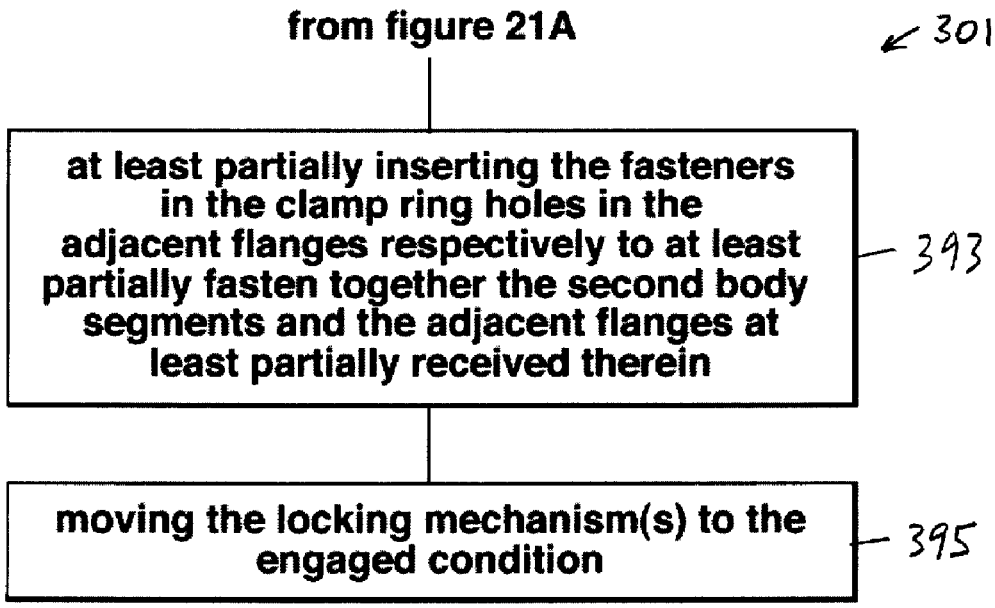
FIG. 21B is a flow chart schematically illustrating a second part of the method of FIG. 21A.

Another embodiment of a method 301 of assembling the slide 120 includes, first, providing a number of the sections 136 (step 365, FIG. 21A). The sections 136 in each selected pair 141 are positioned in the preselected positions therefor (step 367). The first body segments 152A are positioned on the pairs 147 of adjacent flanges 144 respectively (step 383). Next, the first body segments 152A are located on the pairs 147 of adjacent flanges 144 respectively, to align the clamp ring holes 153 with the flange holes 151 in the adjacent flanges 144 (step 385). Fasteners 155 are at least partially inserted in the clamp ring holes 153 of the first body segments 152A and the aligned flange holes 151, to at least partially fasten together the first body segments 152A and the adjacent flanges 144 at least partially received therein (step 387). Second body segments 152B are also positioned on the pairs 147 of adjacent flanges 144 respectively (step 389). The second body segments 152B are located on the pairs 147 of adjacent flanges 144 respectively to substantially align the clamp ring holes 153 in the second body segments 152B and the flange holes 151 in the pairs 147 of adjacent flanges 144 respectively (step 391). Next, fasteners 155 are at least partially inserted in the clamp ring holes 153 of the second body segments 152B in the aligned flange holes 151 in the adjacent flanges 144 respectively, to at least partially fasten together the second body segments 152B and the adjacent flanges 144 at least partially received therein (step 393, FIG. 21B). The locking mechanism 164 is then moved to the engaged condition to secure the first and second body segments 152A, 152B of each clamp ring together (step 395).

Figure 22A:
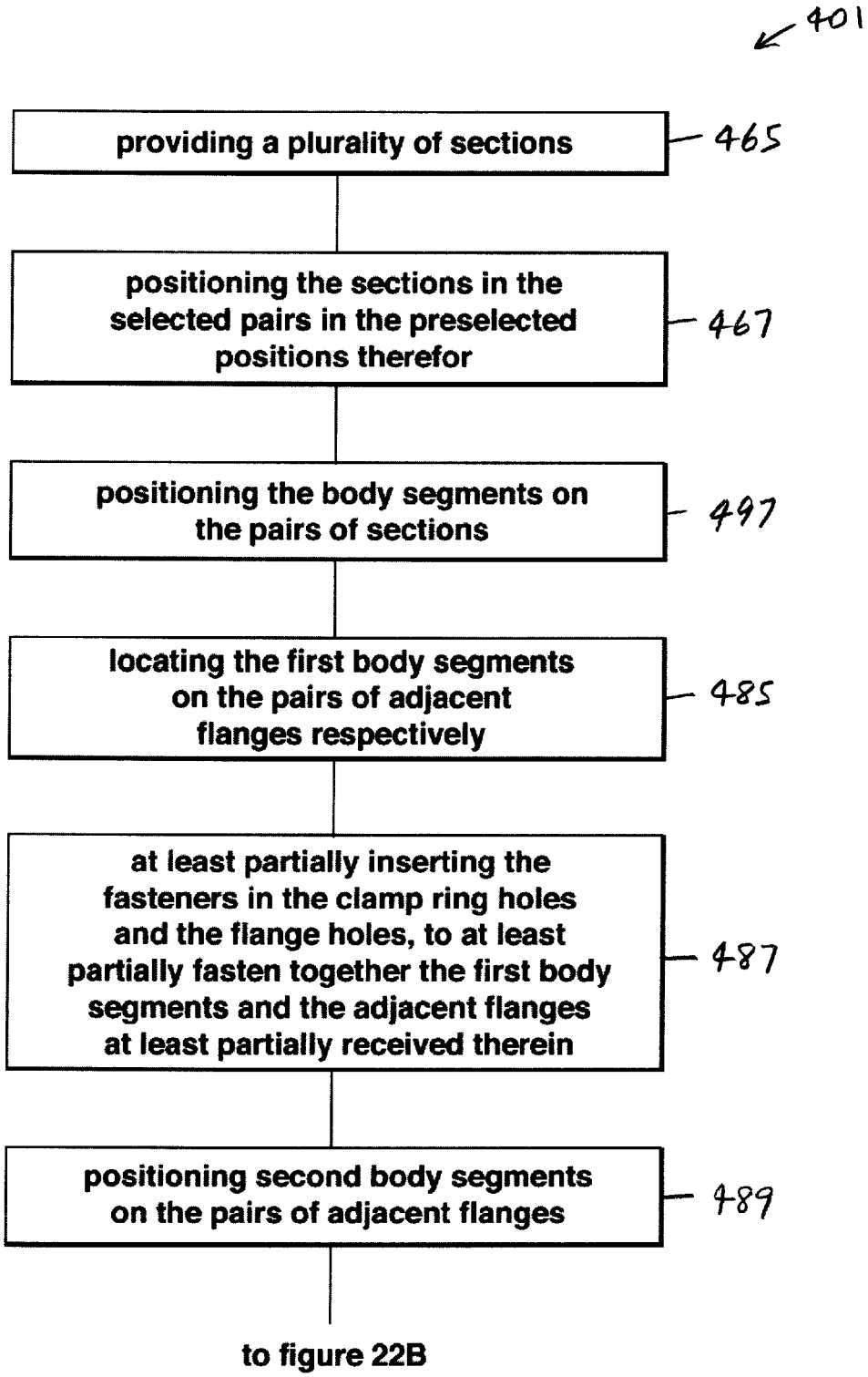
FIG. 22A is a flow chart schematically illustrating a first part of another alternative method of the invention.
Figure 22B:
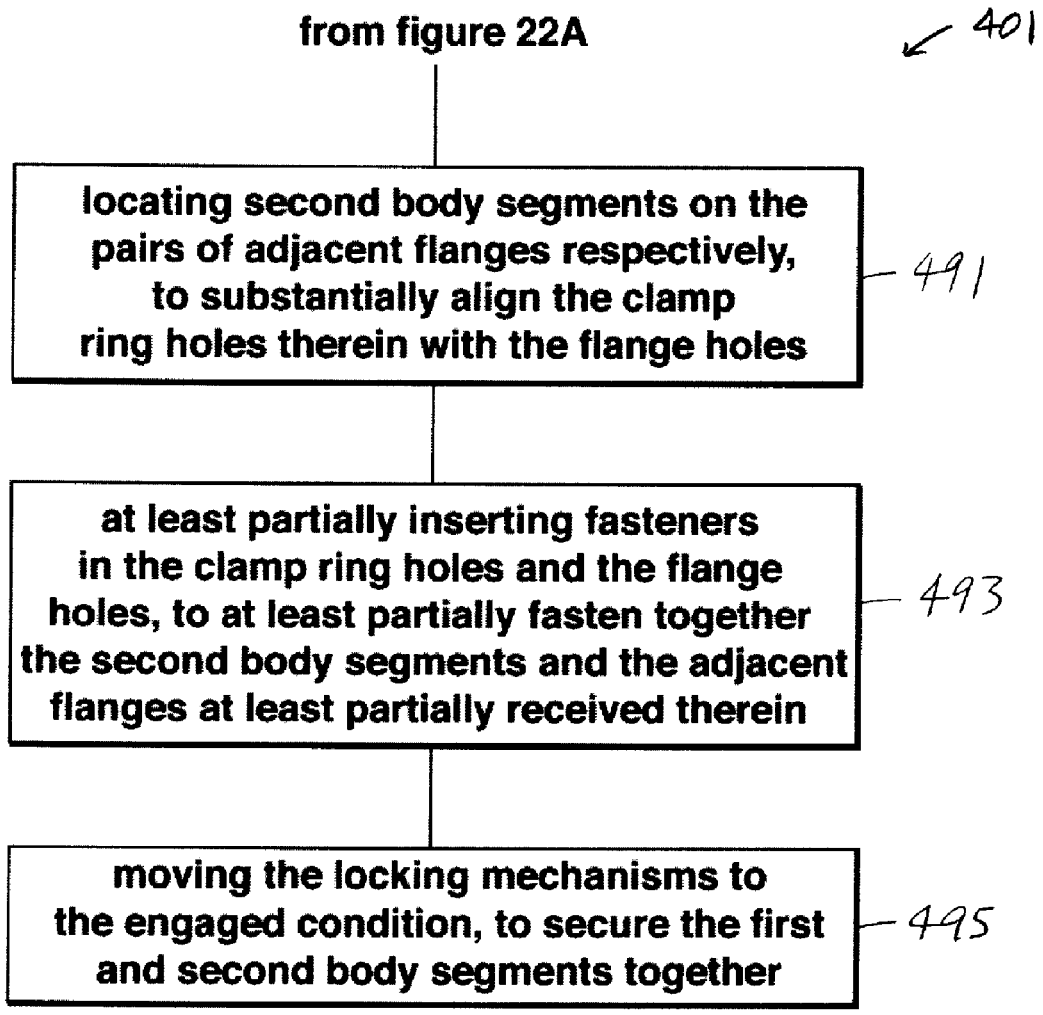

Another embodiment of a method 401 of assembling the slide 120 includes, first, providing a number of sections (step 465, FIG. 22A). The sections 136 in each selected pair 141 are positioned in the preselected positions therefor by substantially aligning indicators 168 on the bodies 142 thereof (step 497). Next, the first body segments 152A are located on the pairs 147 of adjacent flanges 144 respectively, to align the clamp ring holes 153 with the flange holes 151 in the adjacent flanges 144 (step 485). Fasteners 155 are at least partially inserted in the clamp ring holes 153 of the first body segments 152A and the aligned flange holes 151, to at least partially fasten together the first body segments 152A and the adjacent flanges 144 at least partially received therein (step 487). Second body segments 152B are positioned on the pairs 147 of adjacent flanges 144 respectively (step 489). The second body segments 152B are located on the pairs 147 of adjacent flanges 144 respectively to substantially align the clamp ring holes 153 in the second body segments 152B and the flange holes 153 in the pairs 147 of adjacent flanges 144 respectively (step 491, FIG. 22B). Next, fasteners 155 are at least partially inserted in the clamp ring holes 153 of the second body segments 152B in the aligned flange holes 151 in the adjacent flanges 144 respectively, to at least partially fasten together the second body segments 152B and the adjacent flanges 144 at least partially received therein (step 493). The locking mechanism 164 is then moved to the engaged condition, to secure the first and second body segments of each clamp ring together (step 495).

Any element in a claim that does not explicitly state "means for" performing a specified function, or "step for" performing a specific function, is not to be interpreted as a "means" or a "step" clause as specified in 35 U.S.C. §112, paragraph 6.

It will be appreciated by those skilled in the art that the invention can take many forms, and that such forms are within the scope of the invention as claimed. Therefore, the spirit and scope of the appended claims should not be limited to the descriptions of the preferred versions contained herein.

I claim:

1. An enclosed slide comprising:

a plurality of elongate sections at least partially defining an elongate slide bed;

each said section extending between a first end and a second end thereof, said sections being fastened together in abutting end-to-end relations respectively in a predetermined configuration in which selected pairs of said sections are positioned end-to-end in preselected positions relative to each other respectively;

each said section comprising:

a body defining at least a part of the slide bed;

at least one flange extending outwardly from the body, said at least one flange being positioned substantially at one of said ends;

said flanges positioned at each said abutting two ends of said sections in each said selected pair comprising a pair of said flanges positionable adjacent to each other, and each said flange in each said pair of said adjacent flanges comprising a plurality of flange holes substantially aligned with each other when said selected pair of said sections comprising said pair of said adjacent flanges are in the preselected positions therefor;

a plurality of clamp rings adapted for securing said adjacent flanges in each said selected pair of said sections to each other respectively, each said pair of said adjacent flanges being at least partially receivable in said clamp rings respectively, each said clamp ring comprising a plurality of clamp ring holes substantially alignable with said flange holes in said pair of said adjacent flanges respectively when said selected pair of said sections comprising said pair of said adjacent flanges are in the preselected positions therefor; and a plurality of fasteners at least partially positionable in said flange holes and in said clamp ring holes upon alignment thereof, to at least partially fasten said clamp rings respectively to said adjacent flanges at least partially received therein, for securing together said selected pair of said sections on which said pair of said adjacent flanges are located when in the preselected positions therefor.

2. An enclosed slide according to claim 1 in which each said clamp ring comprises at least one body segment defining at least one slot in which said pair of said adjacent flanges is at least partially receivable.

3. An enclosed slide according to claim 1 in which, when said selected pair of said sections are located in the preselected positions therefor relative to each other, said pair of said adjacent flanges located thereon are substantially engaged with each other in a side-by-side relation to each other.

4. An enclosed slide according to claim 1 in which each said clamp ring comprises a plurality of body segments positioned in end-to-end relation to each other when fastened to each said pair of said adjacent flanges respectively.

5. An enclosed slide according to claim 4 in which each said clamp ring comprises at least one locking mechanism for locking said body segments together in end-to-end relation, to at least partially hold each said clamp ring on each pair of said adjacent flanges respectively.

6. An enclosed slide according to claim 5 in which each said at least one locking mechanism is movable between an engaged condition, in which said body segments are secured to each other, and a disengaged condition, in which said body segments are unsecured to allow movement of said adjacent flanges in said pair relative to each other.

7. An enclosed slide according to claim 6 in which:

each said section comprises at least one indicator positioned on the body of each said section respectively; and said sections in each said selected pair thereof are located in the preselected positions relative to each other when said at least one indicator on the bodies of said sections in each said selected pair of sections are substantially aligned.

8. An enclosed slide according to claim 7 in which:

when said selected pair of said sections are in the preselected position therefor, said at least one indicator on each of the bodies of said sections in said selected pair is substantially aligned with said at least one locking mechanism in said clamp ring positioned thereon.

9. An enclosed slide according to claim 6, the method of assembly thereof comprising:

(a) providing said sections;

(b) positioning said sections in each selected pair in the preselected positions therefor respectively;

(c) positioning first body segments on the pairs of said adjacent flanges respectively, such that said adjacent flanges are partially received in said first body segments respectively;

(d) locating said first body segments on said pairs of said adjacent flanges respectively, to substantially align said clamp ring holes therein with the flange holes in said adjacent flanges;

(e) at least partially inserting said fasteners in said clamp ring holes of the first body segments and said flange holes respectively, to at least partially fasten together said first body segments and said adjacent flanges at least partially received therein respectively;

(f) positioning second body segments on said pairs of said adjacent flanges respectively, such that said adjacent flanges are partially received in said second selected body segments respectively;

(g) locating said second body segments on said pairs of said adjacent flanges respectively, to substantially align said clamp ring holes therein with the flange holes in said adjacent flanges;

(h) at least partially inserting said fasteners in said clamp ring holes of the second body segments and said flange holes respectively, to at least partially fasten together said second body segments and said adjacent flanges at least partially received therein respectively; and (i) moving said at least one locking mechanism in the clamp rings to the engaged condition, to secure the first and second selected body segments together.

10. An enclosed slide according to claim 1 additionally comprising at least one indicator disposed on the body of each said section respectively for locating each said section in each said selected pair respectively relative to each other in the preselected positions therefor.

11. An enclosed slide according to claim 10 in which said sections in each said selected pair are in the preselected positions relative to each other when each said at least one indicator on said sections in each said selected pair are substantially aligned with each other respectively.

12. An enclosed slide according to claim 11, the method of assembly thereof comprising:

(a) providing said sections;

(b) positioning said sections in each selected pair in the preselected positions therefor respectively by substantially aligning said at least one indicator on each said body in each said selected pair of sections with said at least one indicator on the other section in each said selected pair;

(c) positioning first body segments on said pairs of said adjacent flanges respectively, such that said adjacent flanges are partially received in said first body segments respectively;

(d) locating said first body segments on said pairs of said adjacent flanges respectively, to substantially align said clamp ring holes therein with the flange holes in said adjacent flanges;

(e) at least partially inserting said fasteners in said clamp ring holes of said first body segments and said flange holes respectively, to at least partially fasten together said first body segments and said adjacent flanges at least partially received therein respectively;

(f) positioning second body segments on said pair of said adjacent flanges respectively, such that said adjacent flanges are partially received in said second body segments respectively;

(g) locating said second body segments on said pairs of said adjacent flanges respectively, to substantially align said clamp ring holes therein with the flange holes in said adjacent flanges;

(h) at least partially inserting said fasteners in said clamp ring holes of said second body segments and said flange holes respectively, to at least partially fasten together said second body segments and said adjacent flanges at least partially received therein respectively; and (i) moving said at least one locking mechanism in the clamp rings to the engaged condition, to secure the first and second body segments together.

13. An enclosed slide according to claim 11 the method comprising:

(a) providing said sections;

(b) positioning said sections in each selected pair in the preselected positions therefor respectively by substantially aligning said at least one indicator on each said body in each said selected pair of sections with said at least one indicator on the other section in each said selected pair;

(c) positioning first body segments on said pairs of said adjacent flanges respectively, such that said adjacent flanges are partially received in said first body segments respectively;

(d) locating said first body segments on said pairs of said adjacent flanges respectively, to substantially align said clamp ring holes therein with the flange holes in said adjacent flanges;

(e) at least partially inserting said fasteners in said clamp ring holes of said first body segments and said flange holes respectively, to at least partially fasten together said first body segments and said adjacent flanges at least partially received therein respectively;

(f) positioning second body segments on said pairs of said adjacent flanges respectively, such that said adjacent flanges are partially received in said second selected body segments respectively;

(g) locating said second body segments on said pairs of said adjacent flanges respectively, to substantially align said clamp ring holes therein with the flange holes in said adjacent flanges;

(h) at least partially inserting said fasteners in said clamp ring holes of the second body segments and said flange holes respectively, to at least partially fasten together said second body segments and said adjacent flanges at least partially received therein respectively; and (i) moving said at least one locking mechanism in the clamp rings to the engaged condition, to secure the first and second selected body segments together.

14. An enclosed slide according to claim 1 in which said sections comprise:

a top section;

a bottom section; and a plurality of connecting sections adapted to be positioned end-to-end in the predetermined configuration for connecting the top and bottom sections.

15. An enclosed slide according to claim 14 in which, when said sections are connected together in the predetermined configuration, the slide bed extends between the top and bottom sections.

16. An enclosed slide according to claim 15 in which the slide bed comprises a plurality of substantially smooth surfaces in each said section respectively positioned to mate with each other when said sections are connected together in the predetermined configuration such that the smooth surfaces in each said section collectively form a substantially continuous surface of the slide bed.

17. An enclosed slide according to claim 1 in which the sections comprise a plurality of parts of the slide bed adapted to cooperate with each other, when said sections are connected together in the predetermined configuration, to form the slide bed.

18. A method of assembling an enclosed slide, the method comprising:

(a) providing a plurality of elongate sections, each said section extending between a first end and a second end, each said section comprising a body and at least one flange extending outwardly from the body, said at least one flange being positioned substantially at one of said ends, said sections being fastenable together in a predetermined configuration in which selected pairs of said sections are positioned abutting end-to-end in preselected positions relative to each other respectively;

(b) positioning said sections in each said selected pair in the preselected positions therefor respectively such that said flanges positioned at each said abutting two ends of said sections in each said selected pair comprise a pair of said flanges adjacent to each other, each said pair of adjacent flanges comprising a plurality of flange holes substantially aligned with each other when said sections in said selected pair are in the predetermined positions therefor;

(c) providing a plurality of clamp rings for securing each said pair of said adjacent flanges to each other respectively, each said clamp ring comprising a plurality of body segments positioned in end-to-end relation to each other when located on each said pair of said adjacent flanges respectively, each said clamp ring comprising a plurality of clamp ring holes substantially alignable with said flange holes respectively, when said adjacent flanges are at least partially received in said clamp ring respectively;

(d) locating said clamp rings on said pairs of adjacent flanges respectively;

(e) at least partially inserting fasteners through the aligned respective flange holes and clamp ring holes; and (f) fastening, with said fasteners, said pair of said adjacent flanges on said sections in each selected pair respectively together with said clamp rings.

19. A kit of parts for an enclosed slide comprising:

an elongate slide bed at least partially defined by a plurality of elongate sections;

each said section extending between a first end and a second end thereof, said sections being fastened together in abutting end-to-end relations respectively in a predetermined configuration in which selected pairs of said sections are positioned end-to-end in preselected positions relative to each other respectively;

each said section comprising:

a body defining at least a part of the slide bed;

at least one flange extending outwardly from the body, said at least one flange being positioned substantially at one of said ends;

said flanges positioned at each said abutting two ends of said sections in each said selected pair comprising a pair of said flanges positionable adjacent to each other, and each said pair of said flanges comprising a plurality of flange holes substantially aligned with each other when said selected pair of said sections comprising said pair of said adjacent flanges are in the preselected positions therefor;

a plurality of clamp rings adapted for securing said adjacent flanges in each said pair of said sections to each other respectively, each said pair of said adjacent flanges being at least partially receivable in said clamp rings respectively, each said clamp ring comprising a plurality of clamp ring holes substantially alignable with said flange holes in said pair of said adjacent flanges respectively when said selected pair of said sections comprising said pair of said adjacent flanges are in the preselected positions therefor; and a plurality of fasteners positionable in said flange holes and in said clamp ring holes upon alignment thereof, to at least partially fasten said clamp rings respectively to said adjacent flanges at least partially received therein, for securing together said selected pair of said sections on which said pair of said adjacent flanges are located when in the preselected positions therefor; and instructions for connecting said sections in abutting end-to-end relations to form the predetermined configuration.

* * * * *